US005871334A

United States Patent [19]

Suzuki et al.

[11] Patent Number: 5,871,334

[45] Date of Patent: Feb. 16, 1999

[54] AIR-CONDITIONER HAVING OUTLET STRUCTURE FOR REDUCING AIR TURBULENCE NOISE

[75] Inventors: Shinichi Suzuki; Akira Takamori, both of Tokyo, Japan

[73] Assignee: Mitsubishi Denki Kabushiki Kaisha, Tokyo, Japan

[21] Appl. No.: 883,898

[22] Filed: Jun. 27, 1997

[30] Foreign Application Priority Data

Nov. 26, 1996 [JP] Japan ..... 8-315032

[51] Int. Cl.[6] ..... F28F 13/12

[52] U.S. Cl. ..... 415/211.2; 415/208.1; 416/247 R; 454/906

[58] Field of Search ..... 454/202, 206, 454/313, 319, 320, 321, 906; 415/208.1, 211.2; 416/247 R

[56] References Cited

U.S. PATENT DOCUMENTS 2,144,035 1/1939 Smith, Jr. ..... 415/211.2 X 2,900,128 8/1959 Piper, Jr. et al. ..... 415/211.2

4,712,611 12/1987 Witzel ..... 415/211.2 X

*Primary Examiner*—Harold Joyce

*Attorney, Agent, or Firm*—Oblon, Spivak, McClelland, Maier & Neustadt, P.C.

[57] ABSTRACT

An outlet structure for an air-conditioner has a fan guard disposed on the outlet side of the air-conditioner for preventing foreign matter from entering to an air blower, and at least one air-direction control vane disposed upstream and/or downstream of the fan guard. The fan guard has elements, except for an outer frame, not in parallel to the rear edge of the upstream air-direction control vane or the front edge of the downstream air-direction control vane. Even in the case where the distance between a fan guard and air-direction control vanes is reduced, and airflows interfere with the fan guard and the air-direction control vanes as the size of air-conditioners is progressively reduced, air-turbulence noise may be reduced.

13 Claims, 11 Drawing Sheets

1
2
19

19
3
4

19
2
3
3

19
3

19

1
2
3
4
5
6
7
9
17
19
20

1
2
19

19
4
3

1
19
3
3

19
3
3

19
3
3

1
2
3
5
10
11
12
13
17
19
20

19
14
2

1
14
19

5
11
19
14
2
3
3

19
3
3

19
3
20
17
14
2

1
19
16

19
2
16

5
11
16
19
3
3

19
3
20
3
17

19
3
3
3
3

1
2
2a
19

A
B
2
2a
2a
19

5
11
2a
19
3
3

19
17
3
3
17
20

19
3
3
3
3

AIR-CONDITIONER HAVING OUTLET STRUCTURE FOR REDUCING AIR TURBULENCE NOISE

BACKGROUND OF THE INVENTION

Field of the Invention

This invention relates to an air conditioner. The invention more particularly concerns an outlet structure for an air-conditioner for reducing air-turbulence noise generated by interference between a fan guard and air-direction control vanes. The air-direction control vanes are located in an interior unit of the air-conditioner which includes an air blower whose outlet is required to be equipped with a fan guard to provide against harm caused by a rotor, such as a fan, of the air blower.

Discussion of the Background

Interior unit air-conditioners which are installed in rooms are occasionally required to have a fan guard equipped on the outlet side of an air blower for safety against harm caused by a rotor, such as a fan, of the air blower. It has been prescribed that the grid of the fan guard have a pitch selected not to allow a test finger, according to standards, to easily enter the grid.

Conventional outlet structures for air-conditioners equipped with fan guards have included a sufficient distance between the fan guard and air-direction control vanes. As the size of air-conditioners is progressively reduced in recent years, however, their outlet structure necessarily prevents a sufficient distance from being provided between a fan guard and air-direction control vanes at the outlet of an interior unit air-conditioner. If air-direction control vanes are positioned downstream of a fan guard, for example, then vortices produced downstream of the fan guard interfere with the front edges of the air-direction control vanes. If air-direction control vanes are positioned upstream of a fan guard, then airflows produced downstream of the air-direction control vanes interferes with the fan guard. In either case, air-turbulence noise is generated due to such interference.

FIGS. 11(*a*) to 11(*e*) schematically show an outlet structure for an air-conditioner which suffers the above problems. FIG. 11(*a*) is a front view of the outlet structure of an air-conditioner, and FIG. 11(*c*) is a side view of the outlet structure of the air-conditioner shown in FIG. 11(*a*), in which air-direction control vanes are disposed downstream of a fan guard. FIG. 11(*d*) is a side view of the outlet structure of the air-conditioner shown in FIG. 11(*a*), in which air-direction control vanes are disposed upstream of a fan guard. Further, FIG. 11(*e*) is a side view of the outlet structure of the air-conditioner shown in FIG. 11(*a*), in which air-direction control vanes are disposed upstream and downstream of the fan guard.

In FIGS. 11(*a*) to 11(*e*), a fan guard has an outer frame 1 and a grid 2 disposed in the outer frame 1. Air-direction control vanes 3 are disposed upstream or downstream of the fan guard. The air-direction control vanes 3 rotate about a pivot shaft (not shown) which extends parallel to the longitudinal direction thereof The air-direction control vanes 3, when disposed downstream of the fan guard, have their front edges movable along a path 5. A range 6 is affected by airflows 11 produced downstream of the fan guard.

Since the path 5 of the front edges of the air-direction control vanes 3 overlaps the range 6, vortices generated by the airflows 1 1 produced downstream of the fan guard interfere with the front edges of the air-direction control vanes 3 along their full length, generating air-turbulence noise.

Especially when the air-direction control vanes 3 rotate, the difference of the noise levels is large when the vortices interfere with the front edges and when the vortices do not interfere with the front edges. When the air-direction control vanes 3 rotate continuously while the air-conditioner is in operation, the air-turbulence noise is produced as fluctuating noise, making nearby persons uncomfortable.

SUMMARY OF THE INVENTION

The present invention has been made in an attempt to solve the above problems. It is an object of the present invention to suppress interference with airflows to reduce air-turbulence noise in such a structure that no sufficient distance can be provided between a fan guard and air-direction control vanes.

According to one aspect of the present invention, an air-conditioner has an air blow outlet structure which comprises a fan guard disposed on an outlet side of an air blower for preventing foreign matter from entering into said air blower, and at least one air-direction control vane disposed upstream and/or downstream of said fan guard. Elements of said fan guard, except an outer frame, are disposed not in parallel to a rear edge of said upstream air-direction control vane or a front edge of said downstream air-direction control vane in at least a range in which the rear edge of said upstream air-direction control vane or the front edge of said downstream air-direction control vane interferes with an airflow.

In another aspect of the present invention, in the air-conditioner having an air blow outlet structure, said elements of said fan guard, except an outer frame, are disposed not in parallel to a rear edge of said upstream air-direction control vane or a front edge of said downstream air-direction control vane.

In another aspect of the present invention, in the air-conditioner having an air blow outlet structure, said elements of said fan guard, except an outer frame, are disposed in a direction perpendicular to the rear edge of said upstream air-direction control vane or the front edge of said downstream air-direction control vane.

In another aspect of the present invention, in the air-conditioner having an air blow outlet structure, said elements of said fan guard, except an outer frame, are disposed in a direction oblique to the rear edge of said upstream air-direction control vane or the front edge of said downstream air-direction control vane.

In another aspect of the present invention, in the air-conditioner having an air blow outlet structure, said elements of said fan guard, except an outer frame, are disposed in a direction oblique at an acute angle less than 45 degrees to the rear edge of said upstream air-direction control vane or the front edge of said downstream air-direction control vane.

In another aspect of the present invention, in the air-conditioner having an air blow outlet structure, said elements of said fan guard, except an outer frame, are disposed in a plurality of directions oblique to the rear edge of said upstream air-direction control vane or the front edge of said downstream air-direction control vane.

In another aspect of the present invention, in the air-conditioner having an air blow outlet structure, said elements of said fan guard, except an outer frame, are disposed to cross each other in a direction oblique to the rear edge of said upstream air-direction control vane or the front edge of said downstream air-direction control vane.

In another aspect of the present invention, in the air-conditioner having an air blow outlet structure, said elements of said fan guard, except an outer frame, are formed in a tortuous manner.

According to another aspect of the present invention, an air-conditioner has an air blow outlet structure which comprises a fan guard disposed on an outlet side of an air blower for preventing foreign matter from entering into said air blower, and at least one air-direction control vane disposed upstream and/or downstream of said fan guard. Elements of said fan guard, except an outer frame, are formed in a different manner, in a range in which the rear edge of said upstream air-direction control vane or the front edge of said downstream air-direction control vane interferes with an airflow, from the other elements in the other region.

In another aspect of the present invention, in the air-conditioner having an air blow outlet structure, said elements of said fan guard, except an outer frame, are formed in a different cross-sectional shape other than a circular shape in the range in which the rear edge of said upstream air-direction control vane or the front edge of said downstream air-direction control vane interferes with the airflow.

In another aspect of the present invention, in the air-conditioner having an air blow outlet structure, said elements of said fan guard, except an outer frame, being formed in different thickness in the range in which the rear edge of said upstream air-direction control vane or the front edge of said downstream air-direction control vane interferes with the airflow.

In another aspect of the present invention, in the air-conditioner having an air blow outlet structure, said elements of said fan guard, except an outer frame, are formed rectangular in cross section in the range in which the rear edge of said upstream air-direction control vane or the front edge of said downstream air-direction control vane interferes with the airflow.

In another aspect of the present invention, in the air-conditioner having an air blow outlet structure, said elements of said fan guard, except an outer frame, are disposed in a smaller pitch in the range in which the rear edge of said upstream air-direction control vane or the front edge of said downstream air-direction control vane interferes with the airflow.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Preferred embodiments of the present invention will hereinafter be described with reference to the accompanying drawings.

Figure 1:
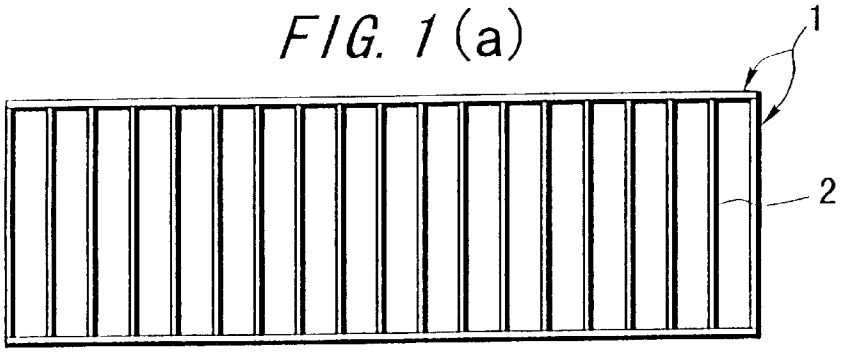
FIGS. 1(*a*) to 1(*e*) are schematic views showing an outlet structure for an air-conditioner according to a first embodiment of the present invention, FIGS. 2(*a*) to 2(*d*) are schematic views showing an outlet structure for an air-conditioner according to a second embodiment of the present invention.
Figure 1:
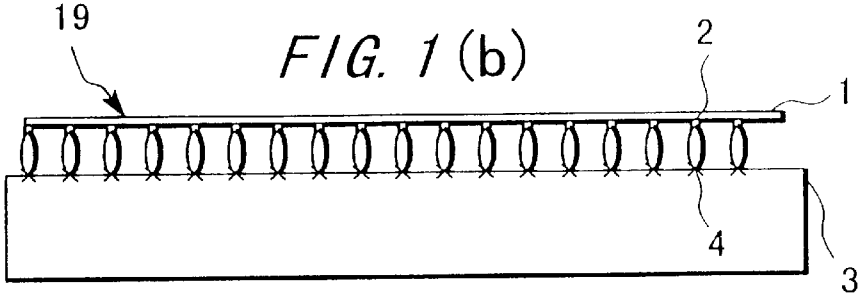
Figure 1:
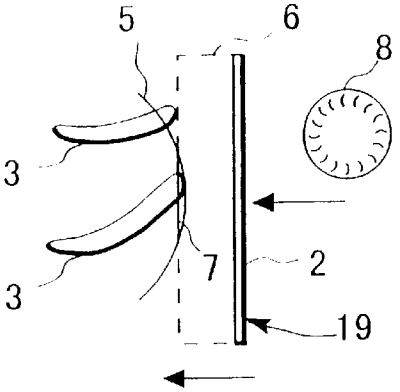
Figure 1:
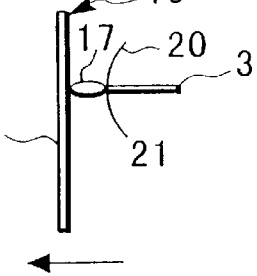
Figure 1:
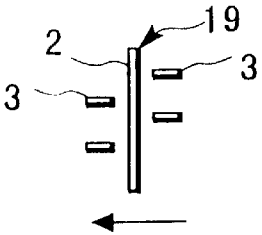

Embodiment 1:

FIGS. 1(*a*) to 1(*e*) schematically show an outlet structure for an air-conditioner according to a first embodiment of the present invention. FIG. 1(*a*) is a front view of the outlet structure of an air-conditioner. FIG. 1(*b*) is a plan view, and FIG. 1(*c*) is a side view of the outlet structure of the air-conditioner shown in FIG. 1(*a*), in which air-direction control vanes are disposed downstream of a fan guard. FIG. 1(*d*) is a side view of the outlet structure of the air-conditioner shown in FIG. 1(*a*), in which air-direction control vanes are disposed upstream of a fan guard. Further, FIG. 1(*e*) is a side view of the outlet structure of the air-conditioner shown in FIG. 1(*a*), in which air-direction control vanes are disposed upstream and downstream of the fan guard. Although not shown, other structural details of the air-conditioner are identical to those of conventional air-conditioners.

As shown in FIGS. 1(*a*) to 1(*e*), the fan guard has an outer frame 1 fitted in an air passage extending from an air blower to an outlet of an interior unit air-conditioner. The outer frame 1 is of a structure which is the same as the conventional outer frame. The fan guard has a grid 2 disposed in the outer frame 1. The grid 2 comprises a plurality of vertical transverse members interconnecting upper and lower longitudinal members of the outer frame 1. Air-direction control vanes 3 are disposed upstream or downstream of the fan guard. Each of the air-direction control vanes 3 has a longitudinal axis parallel to the longitudinal axis of the outer frame 1, and rotates about a pivot shaft (not shown) extending longitudinally through the air-direction control vane 3.

As shown in FIG. 1(*b*), airflows produced downstream of the fan guard by the grid 2 interfere at points 4 with the air-direction control vanes 3 that are positioned downstream of the fan guard. As shown in FIG. 1(*c*), the air-direction control vanes 3 that are positioned downstream of the fan guard have front edges movable along a path 5. In FIG. 1(*c*), a range 6 is affected by the airflows produced downstream of the fan guard. In FIG. 1(*c*), the front edges of the air-direction control vanes 3 interfere with the airflows produced downstream of the fan guard in a range 7. A rotator, such as a fan 8, is positioned with respect to the fan guard as shown in FIG. 1(*c*).

As shown in FIG. 1(*d*), the fan guard, denoted at 19, comprises the outer frame 1 and the grid 2. In FIG. 1(*d*), the air-direction control vanes 3 that are positioned upstream of the fan guard 19 have rear edges movable along a path 20.

In FIG. 1(*d*), airflows produced downstream of the rear edges of the air-direction control vanes 3 interfere with the fan guard 19 in a range 17.

Operation of the outlet structure will be described below. In FIGS. 1(*a*) to 1(*c*), the grid 2 of the fan guard 19 and the air-direction control vanes 3 are substantially perpendicular to each other. The fan guard 19 does not have elements, except for the outer frame 1, parallel to the front edges of the air-direction control vanes 3. In particular, the fan guard 19 has no parallel grid within the range 6 in which interference is effected by the airflows produced downstream of the fan guard 19. Therefore, the points 4 of interference between the airflows produced downstream of the grid 2 of the fan guard 19 and the front edges of the air-direction control vanes 3 that are positioned downstream of the fan guard 19 lie only as points of intersection in a small range as shown in FIG. 1(*b*). As a result, areas where air-turbulence noise is generated by interference are reduced, and any generated air-turbulence noise is reduced.

In FIG. 1(*d*), similarly, the grid 2 of the fan guard and the air-direction control vanes 3 are substantially perpendicular to each other. The fan guard 19 does not have elements, except for the outer frame 1, parallel to the rear edges of the air-direction control vanes 3. In particular, the fan guard 19 has no parallel grid present in the range 17 affected by the airflows produced downstream of the rear edges of the air-direction control vanes 3. Therefore, the points of interference between the airflows produced downstream of the rear edges of the air-direction control vanes 3 and the grid 2 of the fan guard 19 disposed downstream of the air-direction control vanes 3 lie only as points of intersection in a small range as is the case with the structure shown in FIG. 1(*b*). As a result, areas where air-turbulence noise is generated by interference are reduced, and any generated air-turbulence noise is reduced.

In FIG. 1(*e*), the grid 2 of the fan guard 19 and the air-direction control vanes 3 that are positioned upstream and downstream the grid 2 are substantially perpendicular to each other. Consequently, the points of interference between the airflows produced downstream of the rear edges of the upstream air-direction control vanes 3 and the grid 2 of the fan guard 19 and also between the airflows produced downstream of the grid 2 of the fan guard 19 and the front edges of the downstream air-direction control vanes 3 lie only as points of intersection in a small range as is the case with the structures shown in FIGS. 1(*a*) to 1(*d*). As a result, areas where air-turbulence noise is generated by interference are reduced, and any generated air-turbulence noise is reduced.

In FIGS. 1(*a*) to 1(*e*), the air-direction control vanes 3 extend parallel to the longitudinal axis of the outer frame 1 of the fan guard 19. If the air-direction control vanes 3 extend parallel to the transverse axis of the outer frame 1 of the fan guard 19, then the grid 2 may comprise a plurality of members interconnecting the transverse members of the outer frame 1 to provide the same advantages as described above.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

Embodiment 2:

FIGS. 2(*a*) to 2(*d*) schematically show an outlet structure for an air-conditioner according to another embodiment of the present invention. FIG. 2(*a*) is a front view of the outlet structure, FIG. 2(*b*) is a plan view of the outlet structure of the air-conditioner shown in FIG. 2(*a*), in which air-direction control vanes are disposed upstream and downstream of a fan guard. The upstream and downstream air-direction control vanes are perpendicular to each other such that the upstream air-direction control vanes control the direction of air laterally and the downstream air-direction control vanes control the direction of air vertically. FIG. 2(*c*) is a side view of the outlet structure of the air-conditioner shown in FIG. 2(*a*), showing the air-direction control vanes downstream of the fan guard, and FIG. 2(*d*) is a side view of the outlet structure of the air-conditioner shown in FIG. 2(*a*), showing the air-direction control vanes upstream of the fan guard. Structural details of the air-conditioner which are not shown are identical to those of conventional air-conditioners.

As shown in FIGS. 2(*a*) to 2(*d*), a fan guard 19 has an outer frame 1 fitted in an air passage extending from an air blower to an outlet of an interior unit air-conditioner. The outer frame 1 is of a structure which is the same as the conventional outer frame. The fan guard 19 has a grid 2 disposed in the outer frame 1. The grid 2 comprises a plurality of parallel transverse members interconnecting upper and lower longitudinal members of the outer frame 1 and extending obliquely to the longitudinal members at an angle $\alpha$ other than 90°. Air-direction control vanes 3 are disposed upstream or downstream of the fan guard 19. Each of the air-direction control vanes 3 that are disposed downstream of the fan guard 19 has a longitudinal axis parallel to the longitudinal axis of the outer frame 1, and rotates about a pivot shaft (not shown) extending longitudinally through the air-direction control vane 3. Each of the air-direction control vanes 3 that are disposed upstream of the fan guard 19 has each longitudinal axis parallel to the transverse axis of the outer frame 1, and rotate about each pivot shaft (not shown) extending along each longitudinal axis through the air-direction control vane 3.

As shown in FIG. 2(*b*), airflows produced downstream of the fan guard 19 by the grid 2 interfere at points 4 with the air-direction control vanes 3 that are positioned downstream of the fan guard 19. The region of interference present in the second embodiment, as shown in FIG. 2(*c*), is similar to that as shown in FIG. 1(*c*). As is the case with the embodiment shown in FIG. 1(*c*), the air-direction control vanes 3 that are positioned downstream of the fan guard 19 have front edges movable along a path 5. A range 6 is affected by the airflows produced downstream of the fan guard 19, and the front edges of the air-direction control vanes 3 interfere with the airflows produced downstream of the fan guard 19 in a range 7. A rotator, such as a fan, not shown, is positioned with respect to the fan guard 19 as shown in FIG. 1(*c*).

Airflows produced downstream of the rear edges of the air-direction control vanes 3 which are positioned upstream of the fan guard 19 interfere with the fan guard 19, basically, in the same manner as with the embodiment shown in FIG. 1(*d*) though the air-direction control vanes 3 shown in FIG. 2(*d*) extend vertically whereas the air-direction control vanes 3 shown in FIG. 1(*d*) extend horizontally. Specifically, when compared with the FIG. 1(*d*), in which the fan guard 19 comprises the outer frame 1 and the grid 2, the air-direction control vanes 3 that are positioned upstream of the fan guard 19 have rear edges movable along a path 20, and airflows produced downstream of the rear edges of the air-direction control vanes 3 interfere with the fan guard 19 in a range 17, then FIG. 2 corresponds to the case where the upstream air-direction control vanes 3, the path 20, and the range 17 in FIG. 1(*d*) are displaced 90° in a vertical plane.

Operation of the outlet structure will be described below. In FIGS. 2(*a*) to 2(*c*), the grid 2 of the fan guard 19 and the downstream air-direction control vanes 3 cross each other at a predetermined angle. The fan guard 19 does not have elements, except for the outer frame 1, parallel to the front edges of the air-direction control vanes 3. In particular, the fan guard 19 has no parallel grid present in the range 6 which affects the airflows produced downstream of the fan guard 19. Therefore, the points 4 of interference between the airflows produced downstream of the grid 2 of the fan guard 19 and the front edges of the air-direction control vanes 3 that are positioned downstream of the fan guard 19 lie only as points of intersection in a small range as shown in FIG. 2(*b*). As a result, areas where air-turbulence noise is generated by interference are reduced, and any generated air-turbulence noise is reduced.

In FIGS. 2(*a*), 2(*b*), and 2(*d*), similarly, the grid 2 of the fan guard 19 and the upstream air-direction control vanes 3 cross each other at a predetermined angle. The fan guard 19 does not have elements, except for the outer frame 1, parallel to the rear edges of the air-direction control vanes 3. In particular, the fan guard 19 has no parallel grid present in the range affected by the airflows produced downstream of the rear edges of the air-direction control vanes 3. Therefore, the points of interference between the airflows produced downstream of the rear edges of the air-direction control vanes 3 and the grid 2 of the fan guard 19 disposed downstream of the air-direction control vanes 3 lie only as points of intersection in a small range as is the case with the structure shown in FIG. 1(*d*). As a result, areas where air-turbulence noise is generated by interference are reduced, and any generated air-turbulence noise is reduced.

In the case where the air-direction control vanes extend in a plurality of directions, as described above, the grid of the fan guard extends at a predetermined angle with respect to the air-direction control vanes such that the grid does not lie parallel to the longitudinal axis of any of the air-direction control vanes. Consequently, airflows upstream and downstream of the air-direction control vanes interfere with the grid of the fan guard only at points, thereby reducing areas where air-turbulence noise is generated by interference, and hence any generated air-turbulence noise is reduced. Generally, the air-direction control vanes control the direction of discharged air vertically and horizontally. Therefore, the above advantages can be obtained when the grid of the fan guard extends neither horizontally or vertically.

In FIG. 2, the downstream air-direction control vanes 3 extend parallel to the longitudinal axis of the outer frame 1 of the fan guard 19, and the upstream air-direction control vanes 3 extend parallel to the transverse axis of the outer frame 1 of the fan guard 19. However, the downstream air-direction control vanes 3 may extend parallel to the transverse axis of the outer frame 1 of the fan guard 19, and the upstream air-direction control vanes 3 may extend parallel to the longitudinal axis of the outer frame 1 of the fan guard 19 to provide the same advantages as described above.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

Embodiment 3:

FIGS. 3(*a*) to 3(*e*) schematically show an outlet structure for an air-conditioner according to still another embodiment of the present invention. FIG. 3(*a*) is a front view of the outlet structure. FIG. 3(*b*) is a plan view and FIG. 3(*c*) is a side view of the outlet structure of the air-conditioner shown in FIG. 3(*a*), in which air-direction control vanes are disposed downstream of a fan guard. FIG. 3(*d*) is a side view of the outlet structure of the air-conditioner shown in FIG. 3(*a*), in which air-direction control vanes are disposed upstream of a fan guard. Further, FIG. 3(*e*) is a side view of the outlet structure of the air-conditioner shown in FIG. 3(*a*), in which air-direction control vanes are disposed upstream and downstream of the fan guard. Structural details of the air-conditioner which are not shown are identical to those of conventional air-conditioners.

As shown in FIGS. 3(*a*) to 3(*d*), a fan guard 19 has an outer frame 1 fitted in an air passage extending from an air blower to an outlet of an interior unit of an air-conditioner. The outer frame 1 is of a structure which is the same as the conventional outer frame. The fan guard 19 has a grid 2 disposed in the outer frame 1. The grid 2 comprises a plurality of parallel transverse members interconnecting upper and lower longitudinal members of the outer frame 1 and extending at a plurality of predetermined different angles other than 90° with respect to the longitudinal members of the outer frame 1. The transverse members extending at the different angles cross each other. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIG. 3(*b*), airflows produced downstream of the fan guard by the grid 2 interfere at points 4 with the air-direction control vanes 3 that are positioned downstream of the fan guard 19. The region of interference present in the third embodiment, as shown in FIG. 3(*c*) is similar to that as shown in FIG. 1(*c*). As is the case with the embodiment shown in FIG. 1(*c*), the air-direction control vanes 3 that are positioned downstream of the fan guard 19 have front edges movable along a path 5, a range 6 is affected by the airflows produced downstream of the fan guard 19, and the front edges of the air-direction control vanes 3 interfere with the airflows produced downstream of the fan guard 19 in a range 7. A rotator such as a fan, not shown, is positioned with respect to the fan guard as shown in FIG. 1(*c*).

Airflows produced downstream of the rear edges of the air-direction control vanes 3 which are positioned upstream of the fan guard 19 interfere with the fan guard 19, basically, in the same manner as with the embodiment shown in FIG. 1(*d*). Specifically, as in the case with the embodiment shown in FIG. 1(*d*), in which the fan guard 19 comprises an outer frame 1 and the grid 2, the air-direction control vanes 3 that are positioned upstream of the fan guard have rear edges movable along a path 20, and airflows produced downstream of the rear edges of the air-direction control vanes 3 interfere with the fan guard in a range 17, so is the case with the embodiment shown in FIG. 3(*d*).

Operation of the outlet structure will be described below. In FIGS. 3(*a*) to 3(*c*), the grid 2 of the fan guard 19 and the downstream air-direction control vanes 3 cross each other at a predetermined angle. The fan guard 19 does not have elements, except for the outer frame 1, parallel to the front edges of the air-direction control vanes 3. In particular, the fan guard 19 has no parallel grid present in the range 6 which affects the airflows produced downstream of the fan guard 19. Therefore, the points 4 of interference between the airflows produced downstream of the grid 2 of the fan guard 19 and the front edges of the air-direction control vanes 3 that are positioned downstream of the fan guard lie only as points of intersection in a small range as shown in FIG. 3(*b*). As a result, areas where air-turbulence noise is generated by interference are reduced, and any generated air-turbulence noise is reduced.

In FIGS. 3(*a*) and 3(*d*), similarly, the grid 2 of the fan guard 19 and the upstream air-direction control vanes 3 cross each other at a predetermined angle. The fan guard 19 does not have elements, except for the outer frame 1, parallel to the rear edges of the air-direction control vanes 3. In particular, the fan guard 19 has no parallel grid present in the range affected by the airflows produced downstream of the fan guard 19. Therefore, the points 4 of interference between the airflows produced downstream of the rear edges of the air-direction control vanes 3 and the grid 2 of the fan guard 19 that is positioned downstream of the air-direction control vanes 3 lie only as points of intersection in a small range as is the case with the embodiment shown in FIG. 1(*d*). As a result, areas where air-turbulence noise is generated by interference are reduced, and any generated air-turbulence noise is reduced.

In FIG. 3(*e*), the grid 2 of the fan guard 19 and the air-direction control vanes 3 that are positioned upstream and downstream the grid 2 cross each other at a predetermined angle. Consequently, the points of interference between the airflows produced downstream of the rear edges of the upstream air-direction control vanes 3 and the grid 2 of the fan guard 19 and also between the airflows produced downstream of the grid 2 of the fan guard 19 and the front edges of the downstream air-direction control vanes 3 lie only as points of intersection in a small range as is the case with the structures shown in FIGS. 3(*a*) to 3(*d*). As a result, areas where air-turbulence noise is generated by interference are reduced, and any generated air-turbulence noise is reduced.

Since the grid has transverse members extending at plural angles to the longitudinal members of the outer frame and crossing each other, points of interference between the fan guard and the air-direction control vanes are reduced, thus reducing areas where air-turbulence noise is generated and hence any generated air-turbulence noise. Because the grid of the fan guard has smaller openings, it can prevent smaller foreign matter from passing through the fan guard. The fan guard is thus made highly resistant to the passing of a test finger.

In FIGS. 3(*a*) to 3(*d*), the upstream and downstream air-direction control vanes 3 extend parallel to each other and also parallel to the longitudinal axis of the outer frame 1 of the fan guard 19. However, as with the second embodiment, the air-direction control vanes 3 may extend in plural directions such that the downstream air-direction control vanes 3 extend parallel to the longitudinal axis of the outer frame 1 of the fan guard 19, and the upstream air-direction control vanes 3 extend parallel to the transverse axis of the outer frame 1 of the fan guard 19. The transverse members of the grid and the air-direction control vanes may extend at predetermined angles, but not in the same direction, to provide the same advantages as with the second embodiment.

Embodiment 4:

FIGS. 4(*a*) to 4(*e*) schematically show an outlet structure for an air-conditioner according to yet still another embodiment of the present invention. FIG. 4(*a*) is a front view of the outlet structure of the air-conditioner. FIG. 4(*b*) is a plan view and FIG. 4(*c*) is a side view of the outlet structure of the air-conditioner shown in FIG. 4(*a*), in which air-direction control vanes are disposed downstream of a fan guard. FIG. 4(*d*) is a side view of the outlet structure of the air-conditioner shown in FIG. 4(*a*), in which air-direction control vanes are disposed upstream of a fan guard. Further, FIG. 4(*e*) is a side view of the outlet structure of the air-conditioner shown in FIG. 4(*a*), in which air-direction control vanes are disposed upstream and downstream of a fan guard. Structural details of the air-conditioner which are not shown are identical to those of conventional air-conditioners.

As shown in FIGS. 4(*a*) to 4(*e*), a fan guard 19 has an outer frame 1 fitted in an air passage extending from an air blower to an outlet of an interior unit air-conditioner. The outer frame 1 is of a structure which is the same as the conventional outer frame. The fan guard 19 has a grid 2 disposed in the outer frame 1. The grid 2 comprises a plurality of longitudinal members interconnecting transverse members of the outer frame 1 parallel to longitudinal members of the outer frame 1. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIG. 4(*b*), airflows produced downstream of the fan guard 19 by an oblique grid 9 (described later on) interfere at points 4 with the air-direction control vanes 3 that are positioned downstream of the fan guard 19. As shown in FIG. 4(*c*), the air-direction control vanes 3 that are positioned downstream of the fan guard 19 have front edges movable along a path 5. In FIG. 4(*c*), a range 6 is affected by the airflows produced downstream of the fan guard 19. In FIG. 4(*c*), the front edges of the air-direction control vanes 3 interfere with the airflows produced downstream of the fan guard 19 in a range 7. The oblique grid 9 is positioned in a region of the fan guard 19 which belongs to the range 6 and is obliquely connected to the grid 2 upward and downward of the range 6.

As shown in FIG. 4(*d*), the fan guard 19 comprises the outer frame 1 and the grid 2. In FIG. 4(*d*), the air-direction control vanes 3 that are positioned upstream of the fan guard have rear edges movable along a path 20. In FIG. 4(*d*), airflows produced downstream of the rear edges of the air-direction control vanes 3 interfere with the fan guard in a range 17. Since the upstream and downstream air-direction control vanes 3 are arranged to align the ranges 6 and 17 with each other, the range in which the oblique grid 9 is formed is held to a minimum.

Operation of the outlet structure will be described below. In FIGS. 4(*a*) to 4(*c*), the oblique grid 9 of the fan guard 19 and the air-direction control vanes 3 cross each other at a predetermined angle. The fan guard 19 does not have elements, except for the outer frame 1 and the grid 2 disposed outside of the ranges 6 and 17, parallel to the front edges of the air-direction control vanes 3. In particular, the fan guard 19 has no parallel grid present in the range 6 which affects the airflows produced downstream of the fan guard 19. Therefore, the points 4 of interference between the airflows produced downstream of the grid 2 of the fan guard 19 and the front edges of the air-direction control vanes 3 that are positioned downstream of the fan guard 19 lie only as points of intersection in a small range as shown in FIG. 4(*b*). As a result, areas where air-turbulence noise is generated by interference are reduced, and any generated air-turbulence noise is reduced.

In FIG. 4(*d*), similarly, the oblique grid 9 of the fan guard 19 and the air-direction control vanes 3 cross each other at a predetermined angle. The fan guard 19 does not have elements, except for the outer frame 1 and the grid 2 disposed outside of the ranges 6 and 17, parallel to the rear edges of the air-direction control vanes 3. In particular, the fan guard 19 has no grid, parallel to the rear edges of the air-direction control vanes 3, present in the range 17 affected by the airflows produced downstream of the fan guard. Therefore, the points of interference between the airflows produced downstream of the rear edges of the air-direction control vanes 3 and the grid 2 of the fan guard 19 that is positioned downstream of the air-direction control vanes 3 lie only as points of intersection in a small range as is the case with the arrangement shown in FIG. 4(*b*). As a result, areas where air-turbulence noise is generated by interference are reduced, and any generated air-turbulence noise is reduced.

In FIG. 4(*e*), the oblique grid 9 of the fan guard 19 and the upstream and downstream air-direction control vanes 3 cross each other at a predetermined angle. Consequently, the points of interference between the airflows produced downstream of the rear edges of the upstream air-direction control vanes 3 and the oblique grid 9 of the fan guard 19 and also between the airflows produced downstream of oblique grid 9 of the fan guard and the front edges of the downstream air-direction control vanes 3 lie only as points of intersection in a small range as is the case with the structures shown in FIGS. 4(*a*) to 4(*d*). As a result, areas where air-turbulence noise is generated by interference are reduced, and any generated air-turbulence noise is reduced. In this embodiment, furthermore, the oblique grid 9 for reducing interference with the upstream air-direction control vanes 3 is formed only in the ranges 6 and 17. Therefore, the grid members in other regions of the fan guard 19 may be of any arbitrary shape most suitable to perform the function of the fan guard 19 or meet other requirements. The outlet structure according to this embodiment is therefore capable of both performing desired functions and reducing air-turbulence noise.

In FIGS. 4(*a*) and 4(*e*), the air-direction control vanes 3 extend parallel to the longitudinal axis of the outer frame 1 of the fan guard 19. However, the air-direction control vanes 3 may extend parallel to the transverse axis of the outer frame 1 of the fan guard 19. With the oblique grid employed, the fourth embodiment provides the same advantages as those of the second and third embodiments.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

Embodiment 5:

FIGS. 5(*a*) to 5(*e*) schematically show an outlet structure for an air-conditioner according to a further embodiment of the present invention. FIG. 5(*a*) is a front view of the outlet structure of an air-conditioner. FIG. 5(*b*) is a plan view and FIG. 5(*c*) is a side view of the outlet structure of the air-conditioner shown in FIG. 5(*a*), in which air-direction control vanes are disposed downstream of a fan guard. FIG. 5(*d*) is a side view of the outlet structure of the air-conditioner shown in FIG. 5(*a*), in which air-direction control vanes are disposed upstream of a fan guard. Further, FIG. 5(*e*) is a side view of the outlet structure of the air-conditioner shown in FIG. 5(*a*), in which air-direction control vanes are disposed upstream and downstream of a fan guard. Structural details of the air-conditioner which are not shown are identical to those of conventional air-conditioners.

As shown in FIGS. 5(*a*) to 5(*d*), a fan guard 19 has an outer frame 1 fitted in an air passage extending from an air blower to an outlet of an interior unit of an air-conditioner. The outer frame 1 is of a structure which is the same as the conventional outer frame. The fan guard 19 has a grid 2 disposed in the outer frame 1. The grid 2 comprises a plurality of parallel oblique transverse members interconnecting upper and lower longitudinal members of the outer frame 1 and extending at an acute angle of other than 90°, preferably less than 45°, with respect to the longitudinal members of the outer frame 1. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIG. 5(*b*), airflows produced downstream of the fan guard 19 by the grid 2 interfere at points 4 with the air-direction control vanes 3 that are positioned downstream of the fan guard 19. The outlet structure for an air-conditioner shown in FIG. 5(*c*) works in the same way as in the case with the embodiment shown in FIG. 1(*c*), in which the air-direction control vanes 3 that are positioned downstream of the fan guard 19 have front edges movable along a path 5, a range 6 is affected by the airflows produced downstream of the fan guard 19, and the front edges of the air-direction control vanes 3 interfere with the airflows produced downstream of the fan guard 19 in a range 7. A rotator, such as a fan, not shown, is positioned with respect to the fan guard as shown in FIG. 1(*c*).

Airflows produced downstream of the rear edges of the air-direction control vanes 3 which are positioned upstream of the fan guard 19 interfere with the fan guard 19, basically, in the same manner as with the embodiment shown in FIG. 1(*d*). Specifically, the outlet structure of the air-conditioner shown in FIG. 5(*d*) works in the same way as in the case with the embodiment shown in FIG. 1(*d*), in which the fan guard 19 comprises the outer frame 1 and the grid 2, the air-direction control vanes 3 that are positioned upstream of the fan guard 19 have rear edges movable along a path 20, and airflows produced downstream of the rear edges of the air-direction control vanes 3 interfere with the fan guard in a range 17.

Operation of the outlet structure will be described below. In FIGS. 5(*a*) to 5(*c*), the grid 2 of the fan guard 19 and the downstream air-direction control vanes 3 cross each other at a predetermined angle. The fan guard 19 does not have elements, except for the outer frame 1, parallel to the front edges of the air-direction control vanes 3. In particular, the fan guard 19 has no parallel grid present in the range 6 which affects the airflows produced downstream of the fan guard 19. Therefore, the points 4 of interference between the airflows produced downstream of the grid 2 of the fan guard 19 and the front edges of the air-direction control vanes 3 that are positioned downstream of the fan guard 19 lie only as points of intersection in a small range as shown in FIG. 5(*b*). As a result, areas where air-turbulence noise is generated by interference are reduced, and any generated air-turbulence noise is reduced.

In FIGS. 5(*a*) and 5(*d*), similarly, the grid 2 of the fan guard 19 and the upstream air-direction control vanes 3 cross each other at a predetermined angle. The fan guard 19 does not have elements, except for the outer frame 1, parallel to the rear edges of the air-direction control vanes 3. In particular, the fan guard 19 has no parallel grid present in the range affected by the airflows produced downstream of the fan guard 19. Therefore, the points 4 of interference between the airflows produced downstream of the rear edges of the air-direction control vanes 3 and the grid 2 of the fan guard 19 which is positioned downstream of the air-direction control vanes 3 lie only as points of intersection in a small range as is the case with the embodiment shown in FIG.

1(*d*). As a result, areas where air-turbulence noise is generated by interference are reduced, and any generated air-turbulence noise is reduced.

In FIG. 5(*e*), the grid 2 of the fan guard 19 and the air-direction control vanes 3 that are positioned upstream and downstream of the grid 2 cross each other at a predetermined angle. Consequently, the points of interference between the airflows produced downstream of the rear edges of the upstream air-direction control vanes 3 and the grid 2 of the fan guard 19 and also between the airflows produced downstream of the grid 2 of the fan guard 19 and the front edges of the downstream air-direction control vanes 3 lie only as points of intersection in a small range as is the case with the structures shown in FIGS. 5(*a*) to 5(*d*). As a result, areas where air-turbulence noise is generated by interference are reduced, and any generated air-turbulence noise is reduced.

For reducing air-turbulence noise, the grids are disposed not in parallel to the air-direction control vanes which have a longest interfering portion and are influential for the generation of noise. As a result, an arrangement is obtained which is most effective in reducing noise for an air-direction control vane. Such an arrangement may effectively be selected when air-direction control vanes are disposed in different directions as in the second embodiment, and provides a large noise reduction capability.

If the grid 2 does not have a large angle with respect to the longitudinal members of the outer frame 1, then the angle formed between the grid 2 and the front or rear edges of the air-direction control vanes 3 parallel to the longitudinal members of the outer frame 1 is small. Thereby, points of interference are reduced between the grid 2 and the air-direction control vanes 3. Thus, areas where air-turbulence noise is generated are reduced. Specifically, when the grid is made not in parallel but at a certain angle to the air-direction control vanes which have most front or rear edges in a longitudinal direction, among the air-direction control vanes which interfere with the fan guard, then the points of interference are limited to points of intersection, and the overall number of points of interference is limited.

In FIG. 5(*e*), the upstream and downstream air-direction control vanes 3 extend parallel to each other and also parallel to the longitudinal axis of the outer frame 1 of the fan guard 19. However, the upstream and downstream air-direction control vanes 3 may extend parallel to the transverse axis of the outer frame 1 of the fan guard 19. In this case, the control vanes 3 have an acute angle with respect to the transverse axis. Furthermore, as in the second embodiment, the air-direction control vanes 3 may extend in plural directions such that the downstream air-direction control vanes 3 extend parallel to the longitudinal axis of the outer frame 1 of the fan guard 19, and the upstream air-direction control vanes 3 extend parallel to the transverse axis of the outer frame 1 of the fan guard 19. The transverse members of the grid and the air-direction control vanes may extend at predetermined angles, but not in the same angle, to provide the same advantages as in the second embodiment. Those air-direction control vanes which have most front or rear edges in a longitudinal direction among the air-direction control vanes which interfere with the fan guard are disposed not in parallel to but at an acute angle with respect to the grid.

Figures 6A, 6B, 6C, 6D, 6E:
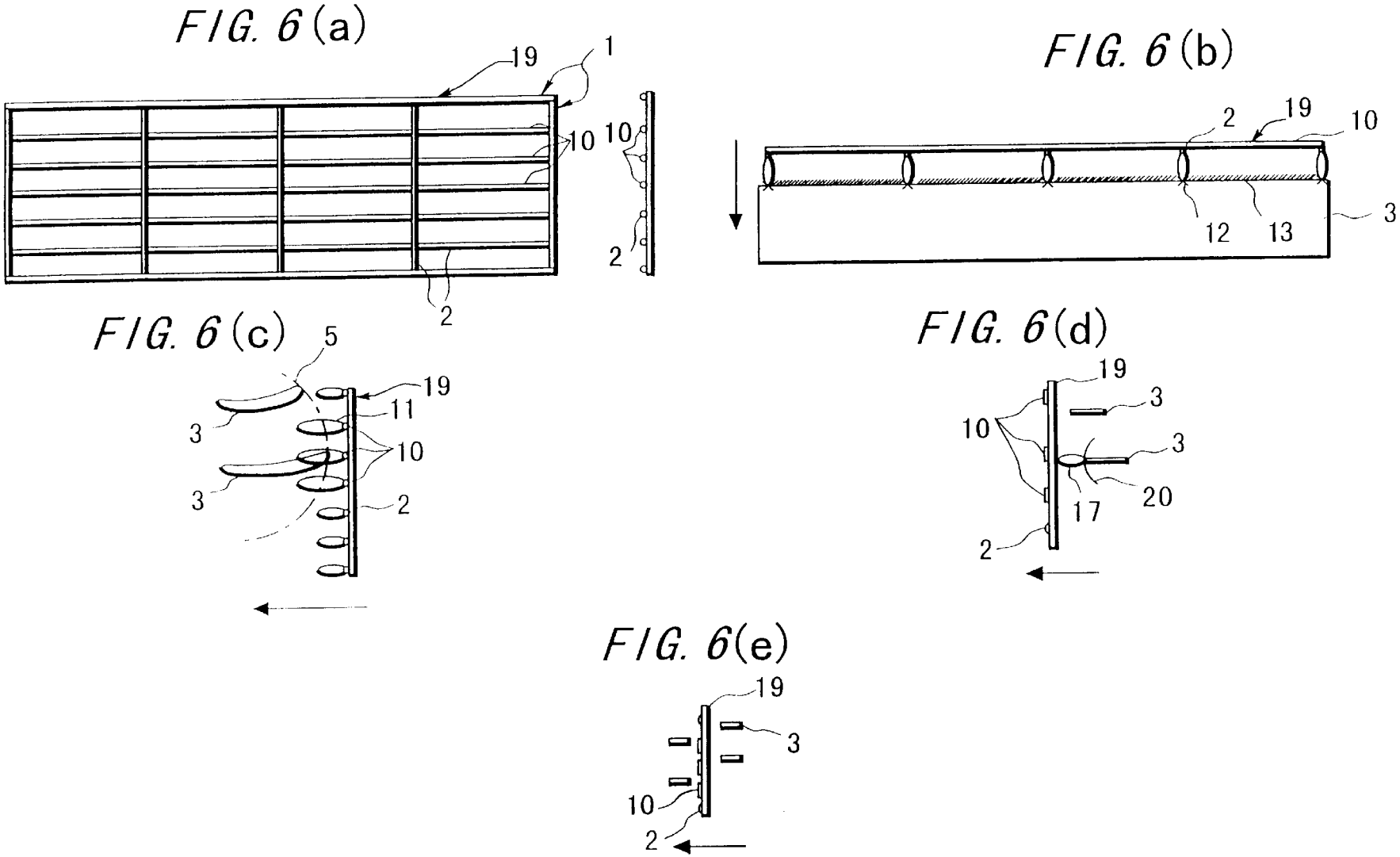
FIGS. 6(*a*) to 6(*e*) are schematic views showing an outlet structure for an air-conditioner according to a sixth embodiment of the present invention.

Embodiment 6:

FIGS. 6(*a*) to 6(*e*) schematically show an outlet structure for an air-conditioner according to a still further embodiment of the present invention. FIG. 6(*a*) is a front view of the outlet structure of an air-conditioner. FIG. 6(*b*) is a plan view and FIG. 6(*c*) is a side view of the outlet structure of the air-conditioner shown in FIG. 6(*a*), in which air-direction control vanes are disposed downstream of a fan guard. FIG. 6(*d*) is a side view of the outlet structure of the air-conditioner shown in FIG. 6(*a*), in which air-direction control vanes are disposed upstream of a fan guard. Further, FIG. 6(*e*) is a side view of the outlet structure of the air-conditioner shown in FIG. 6(*a*), in which air-direction control vanes are disposed upstream and downstream of the fan guard. Structural details of the air-conditioner which are not shown are identical to those of conventional air-conditioners.

As shown in FIGS. 6(*a*) to 6(*e*), a fan guard 19 has an outer frame 1 fitted in an air passage extending from an air blower to an outlet of an interior unit of an air-conditioner. The outer frame 1 is of a structure which is the same as the conventional outer frame. The fan guard 19 has a grid 2 disposed in the outer frame 1. The grid 2 comprises a plurality of vertical transverse members interconnecting upper and lower longitudinal members of the outer frame 1 and a plurality of horizontal longitudinal members interconnecting lateral transverse members of the outer frame 1. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIGS. 6(*a*) to 6(*e*), the fan guard 19 has a grid 10 disposed in the outer frame 1 and comprising members each having a flat cross-sectional shape compared with other members of the grid 2 which has a circular cross-sectional shape.

As shown in FIG. 6(*b*), airflows produced downstream of the fan guard 19 by the transverse members of the grid 2 interfere at points 12 with the air-direction control vanes 3 that are positioned downstream of the fan guard 19.

As shown in FIG. 6(*c*), the air-direction control vanes 3 that are positioned downstream of the fan guard 19 have front edges movable along a path 5. Airflows 1I1 are produced downstream of the fan guard 19 by the grid 10. Airflows produced by the grid 10 interfere with the air-direction control vanes 3 in a zone 13 as shown in FIG. 6(*b*). Therefore, the grid 10, rather than the grid 2, is positioned in a region where the airflows produced downstream of the fan guard 19 interfere with the air-direction control vanes 3.

As shown in FIG. 6(*d*), the fan guard 19 comprises the outer frame 1, the grid 2, and the grid 10. In FIG. 6(*d*), the air-direction control vanes 3 that are positioned upstream of the fan guard 19 have rear edges movable along a path 20. In FIG. 6(*d*), airflows produced downstream of the rear edges of the air-direction control vanes 3 interfere with the fan guard 19 in a range 17. Since the upstream and downstream air-direction control vanes 3 are arranged to align the range affected by the airflows produced downstream of the fan guard 19 and the range 17 with each other, the range in which the grid 10 is formed is held to a minimum.

Operation of the outlet structure will be described below. In FIGS. 6(*a*) to 6(*c*), the grid 10 of the fan guard 19 and the air-direction control vanes 3 are substantially parallel to each other. Because of the cross-sectional shape of the members of the grid 10, the airflows produced by the grid 10 interfere with the air-direction control vanes 3 in a manner different from the manner in which the airflows produced by the grid 2 interfere with the air-direction control vanes 3. The grid 10 is capable of changing the position of strong vortices generated downstream of the fan guard 19 for thereby changing the frequency or intensity of air-turbulence noise into a frequency or intensity which is too low to be audibly perceptible. Alternatively, the grid 10 is capable of changing the position of strong vortices into a forward position out of interference with the air-direction control vanes 3, and thereby any generated air-turbulence noise is reduced. The latter alternative is also effective to reduce a reduction in the air volume which is caused by the resistance of the fan guard 19. Each member of the grid 10 may be of a triangular or lozenge cross-sectional shape, rather than the flat cross-sectional shape, or may be oriented to be more resistant or less resistant to the airflows.

In FIG. 6(*d*), similarly, the grid 10 of the fan guard 19 and the air-direction control vanes 3 are substantially parallel to each other. Because of the cross-sectional shape of the members of the grid 10, the airflows produced by the grid 10 interfere with the air-direction control vanes 3 in a manner different from the manner in which the airflows produced by the grid 2 interfere with the air-direction control vanes 3, for reducing air-turbulence noise.

In FIG. 6(*e*), the grid 10 of the fan guard 19 and the air-direction control vanes 3 which are positioned upstream and downstream of the fan guard 19 are substantially parallel to each other. As is the case with the arrangement shown in FIGS. 6(*a*) to 6(*d*), because of the cross-sectional shape of the members of the grid 10, the airflows produced by the grid 10 interfere with the air-direction control vanes 3 in a manner different from the manner in which the airflows produced by the grid 2 interfere with the air-direction control vanes 3, for reducing air-turbulence noise.

In FIGS. 6(*a*) to 6(*e*), the air-direction control vanes 3 extend parallel to the longitudinal axis of the outer frame 1 of the fan guard 19. If the air-direction control vanes 3 extend parallel to the transverse axis of the outer frame 1 of the fan guard 19, then the grid 10 may comprise a plurality of members interconnecting the upper and lower longitudinal members of the outer frame 1 to provide the same advantages as described above.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

Figures 7A, 7B, 7C, 7D, 7E:
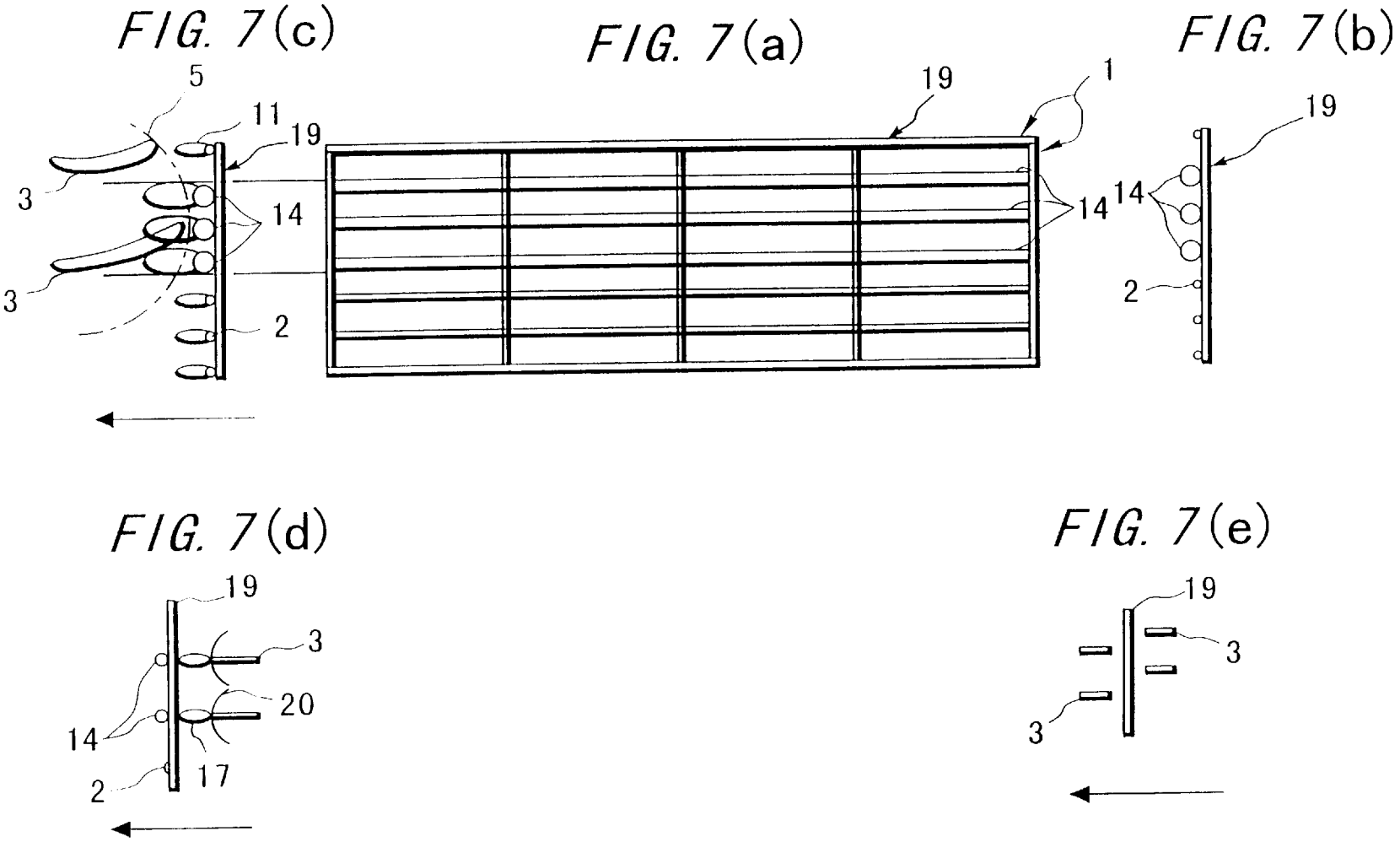
FIGS. 7(*a*) to 7(*e*) are schematic views showing an outlet structure for an air-conditioner according to a seventh embodiment of the present invention.

Embodiment 7:

FIGS. 7(*a*) to 7(*e*) schematically show an outlet structure for an air-conditioner according to a yet still further embodiment of the present invention. FIG. 7(*a*) is a front view of the outlet structure of an air-conditioner. FIG. 7(*b*) is a side view of the outlet structure of the air-conditioner shown in FIG. 7(*a*). FIG. 7(*c*) is a side view of the outlet structure of the air-conditioner shown in FIG. 7(*a*), in which air-direction control vanes are disposed downstream of a fan guard. FIG. 7(*d*) is a side view of the outlet structure of an air-conditioner shown in FIG. 7(*a*), in which air-direction control vanes are disposed upstream of a fan guard. Further, FIG. 7(*e*) is a side view of the outlet structure of the air-conditioner shown in FIG. 7(*a*), in which air-direction control vanes are disposed upstream and downstream of a fan guard. Structural details of the air-conditioner which are not shown are identical to those of conventional air-conditioners.

As shown in FIGS. 7(*a*) to 7(*e*), a fan guard 19 has an outer frame 1 fitted in an air passage extending from an air blower to an outlet of an interior unit air-conditioner. The outer frame 1 is of a structure which is the same as the conventional outer frame. The fan guard 19 has a grid 2 disposed in the outer frame 1. The grid 2 comprises a plurality of vertical transverse members interconnecting upper and lower longitudinal members of the outer frame 1 and a plurality of horizontal longitudinal members interconnecting lateral transverse members of the outer frame 1. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIGS. 7(*a*) to 7(*e*), the fan guard 19 has a grid 14 disposed in the outer frame 1 and comprising members each having a diameter greater than the diameter of each of the members of the grid 2 which has a circular cross-sectional shape.

As shown in FIG. 7(*c*), the air-direction control vanes 3 that are positioned downstream of the fan guard have front edges movable along a path 5. As shown in FIG. 7(*c*), airflows 11 are produced downstream of the fan guard 19 by the grids 2 and 14. The grid 14, rather than the grid 2, is positioned in a region where the airflows produced downstream of the fan guard interfere with the air-direction control vanes 3.

As shown in FIG. 7(*d*), the fan guard 19 comprises the outer frame 1, the grid 2, and the grid 14. In FIG. 7(*d*), the air-direction control vanes 3 that are positioned upstream of the fan guard 19 have rear edges movable along a path 20. In FIG. 7(*d*), airflows produced downstream of the rear edges of the air-direction control vanes 3 interfere with the fan guard 19 in a range 17.

In FIG. 7(*e*), since the upstream and downstream air-direction control vanes 3 are arranged to align the range affected by the airflows produced downstream of the fan guard 19 and the range 17 with each other, the range in which the grid 10 is formed is held to a minimum.

Operation of the outlet structure will be described below. In FIGS. 7(*a*) to 7(*c*), the grid 14 of the fan guard 19 and the air-direction control vanes 3 are substantially parallel to each other. Because of the cross-sectional shape of the members of the grid 14, the airflows produced by the grid 14 interfere with the air-direction control vanes 3 in a manner different from the manner in which the airflows produced by the grid 2 interfere with the air-direction control vanes 3. The grid 14 is capable of changing the position of strong vortices generated downstream of the fan guard 19 for thereby changing the frequency or intensity of air-turbulence noise into a frequency or intensity which is too low to be audibly perceptible. Alternatively, the grid 14 is capable of changing the position of strong vortices into a forward position out of interference with the air-direction control vanes 3, and thereby any generated air-turbulence noise is reduced. Each member of the grid 14 may have a diameter larger or smaller than the diameter of each member of the grid 2. Alternatively, bristles may be mounted on some members of the grid 2 to make their apparent diameter different from the diameter of the other members of the grid 2 to provide the same advantages as described above. Further, alternatively, each of the members of the grid 2 may have portions of different diameters.

Since the longitudinal and transverse members of the grid extend perpendicularly to each other, they may be welded at a reduced number of welding locations, resulting in a reduced manufacturing cost, when the fan guard is manufactured using a spot welding process. If grid members of one diameter are welded together and only necessary grid members are bristled to increase their diameter, then vortices produced by the bristled members are more disturbed than vortices produced by solid members, thus reducing air-turbulence noise generated by interference between the vortices and the air-direction control vanes. Though grid members having different diameters cannot be welded as easily as the grid members having the same diameter, they can easily be manufactured because no bristling process is needed.

In FIG. 7(*d*), similarly, the grid 14 of the fan guard 19 and the air-direction control vanes 3 are substantially parallel to each other. Because of the larger diameter of the members of the grid 14, the airflows produced by the grid 14 interfere with the air-direction control vanes 3 in a manner different from the manner in which the airflows produced by the grid 2 interfere with the air-direction control vanes 3, for reducing air-turbulence noise.

In FIG. 7(*e*), the grid 14 of the fan guard 19 and the air-direction control vanes 3 which are positioned upstream and downstream of the fan guard 19 are substantially parallel to each other. As is the case with the arrangement shown in FIGS. 7(*a*) to 7(*d*), because of the different diameter of the members of the grid 14, the airflows produced by the grid 14 interfere with the air-direction control vanes 3 in a manner different from the manner in which the airflows produced by the grid 2 interfere with the air-direction control vanes 3, for reducing air-turbulence noise.

In FIGS. 7(*a*) to 7(*e*), the air-direction control vanes 3 extend parallel to the longitudinal axis of the outer frame 1 of the fan guard 19. If the air-direction control vanes 3 extend parallel to the transverse axis of the outer frame 1 of the fan guard 19, then the grid 14 may comprise a plurality of members interconnecting the upper and lower longitudinal members of the outer frame 1 to provide the same advantages as described above.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

Figures 8A, 8B, 8C, 8D, 8E:
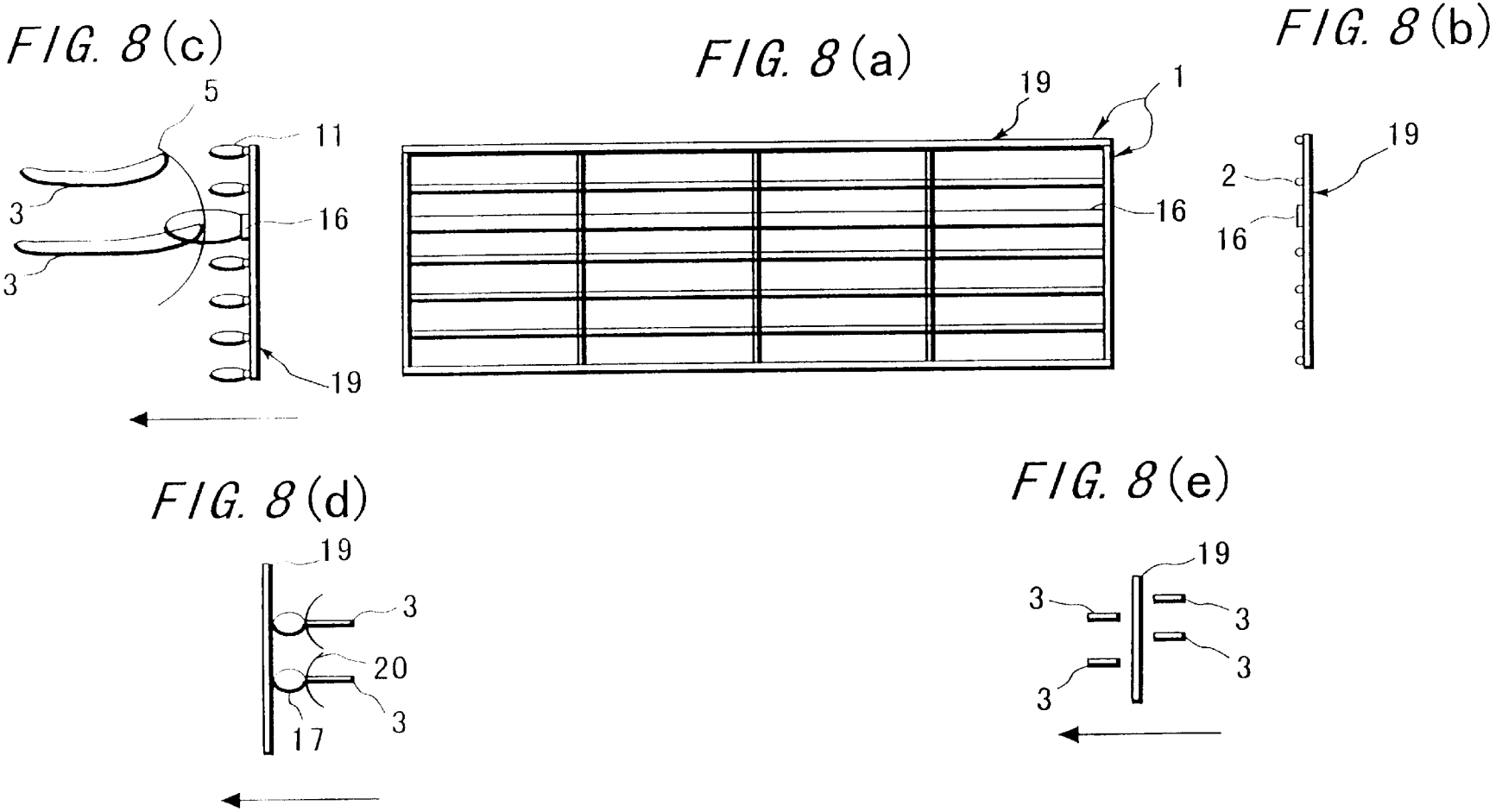
FIGS. 8(*a*) to 8(*e*) are schematic views showing an outlet structure for an air-conditioner according to an eighth embodiment of the present invention.
Figure 9A:
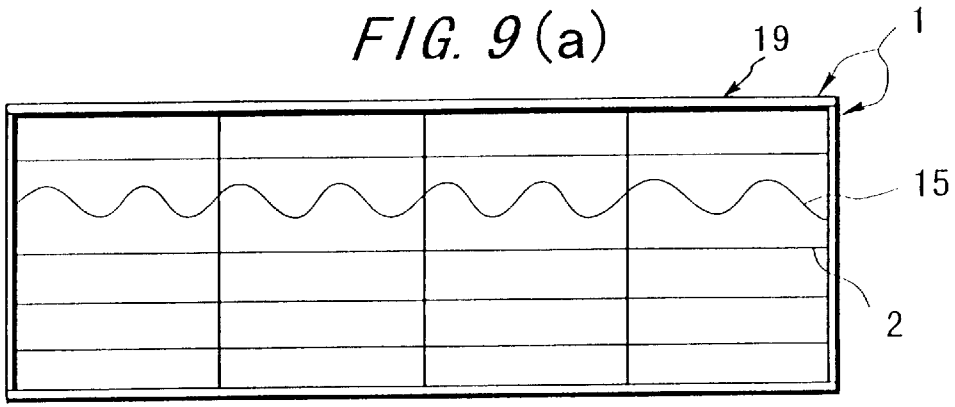
FIGS. 9(*a*) to 9(*e*) are schematic views showing an outlet structure for an air-conditioner according to a ninth embodiment of the present invention.
Figure 9B:
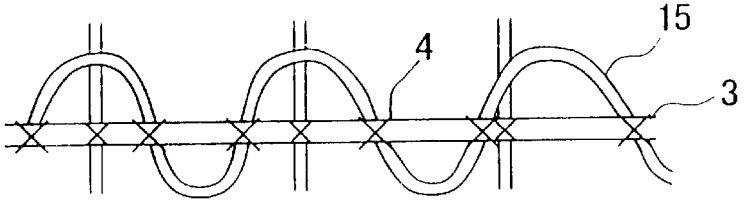
Figure 9C:
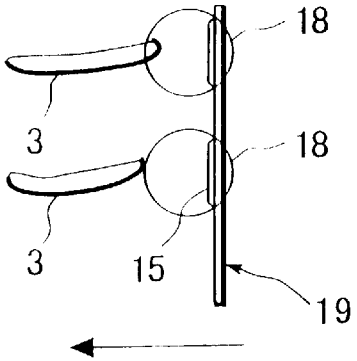
Figure 9D:
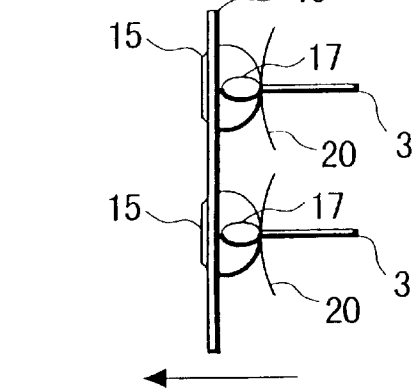
Figure 9E:
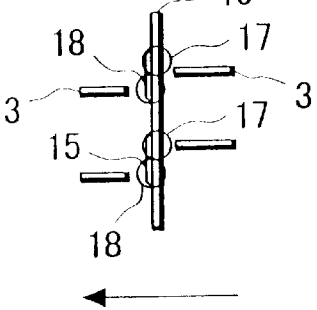

Embodiment 8:

FIGS. 8(*a*) to 8(*e*) schematically show an outlet structure for an air-conditioner according to another embodiment of the present invention. FIG. 8(*a*) is a front view of the outlet structure of an air-conditioner. FIG. 8(*b*) is a side view of the outlet structure of the air-conditioner shown in FIG. 8(*a*). FIG. 8(*c*) is a side view of the outlet structure of the air-conditioner shown in FIG. 8(*a*), in which air-direction control vanes are disposed downstream of a fan guard. FIG. 8(*d*) is a side view of the outlet structure of the air-conditioner shown in FIG. 8(*a*), in which air-direction control vanes are disposed upstream of a fan guard. Further, FIG. 8(*e*) is a side view of the outlet structure of the air-conditioner shown in FIG. 8(*a*), in which air-direction control vanes are disposed upstream and downstream of a fan guard. Structural details of the air-conditioner which are not shown are identical to those of conventional air-conditioners.

As shown in FIGS. 8(*a*) to 8(*e*), a fan guard 19 has an outer frame 1 fitted in an air passage extending from an air blower to an outlet of an interior unit air-conditioner. The outer frame 1 is of a structure which is the same as the conventional outer frame. The fan guard 19 has a grid 2 disposed in the outer frame 1. The grid 2 comprises a plurality of vertical transverse members interconnecting upper and lower longitudinal members of the outer frame 1 and a plurality of horizontal longitudinal members interconnecting lateral transverse members of the outer frame 1. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIG. 8(*c*), the air-direction control vanes 3 that are positioned downstream of the fan guard 19 have front edges movable along a path 5. The fan guard 19 also has a grid 16 disposed in the outer frame 1 and comprising a member having a rectangular plate-like cross-sectional shape. Each of the members of the grid 2 has a circular cross sectional shape. As shown in FIG. 8(*c*), airflows 11 are produced downstream of the fan guard by the grids 2 and 16. The grid 16, rather than the grid 2, is positioned in a region where the airflows produced downstream of the fan guard interfere with the air-direction control vanes 3.

As shown in FIG. 8(*d*), the fan guard 19 comprises the outer frame 1, the grid 2, and the grid 16. In FIG. 8(*d*), the air-direction control vanes 3 that are positioned upstream of the fan guard have rear edges movable along a path 20. In FIG. 8(*d*), airflows produced downstream of the rear edges of the air-direction control vanes 3 interfere with the fan guard 19 in a range 17.

In FIG. 8(*e*), since the upstream and downstream air-direction control vanes 3 are arranged to align the range affected by the airflows produced downstream of the fan guard and the range 17 with each other, the range in which the grid 16 is formed is held to a minimum.

Operation of the outlet structure will be described below. In FIGS. 8(*a*) to 8(*c*), the grid 16 of the fan guard 19 and the air-direction control vanes 3 are substantially parallel to each other. Because of the cross-sectional shape of the member of the grid 16, the airflows produced by the grid 16 interfere with the air-direction control vanes 3 in a manner different from the manner in which the airflows produced by the grid 2 interfere with the air-direction control vanes 3, and thereby any generated air-turbulence noise is reduced. The grid 16 is capable of changing the position of strong vortices generated downstream of the fan guard 19 for thereby changing the frequency or intensity of air-turbulence noise into a frequency or intensity which is too low to be audibly perceptible. Alternatively, the grid 16 is capable of changing the position of strong vortices into a forward position out of interference with the air-direction control vanes 3. The grid 16 may be oriented to be more resistant or less resistant to the airflows. As with the seventh embodiment, since the longitudinal and transverse members of the grid extend perpendicularly to each other, they may be welded at a reduced number of welding locations, resulting in a reduced manufacturing cost, when the fan guard 19 is manufactured using a spot welding process.

In FIG. 8(*d*), similarly, the grid 16 of the fan guard 19 and the air-direction control vanes 3 are substantially parallel to each other. Because of the cross-sectional shape of the member of the grid 16, the airflows produced by the grid 16 interfere with the air-direction control vanes 3 in a manner different from the manner in which the airflows produced by the grid 2 interfere with the air-direction control vanes 3, for reducing air-turbulence noise.

In FIG. 8(*e*), the grid 16 of the fan guard and the air-direction control vanes 3 which are positioned upstream and downstream of the fan guard are substantially parallel to each other. As is the case with the arrangement shown in FIGS. 8(*a*) to 8(*d*), because of the cross-sectional shape of the member of the grid 16, the airflows produced by the grid 16 interfere with the air-direction control vanes 3 in a manner different from the manner in which the airflows produced by the grid 2 interfere with the air-direction control vanes 3, for reducing air-turbulence noise.

In FIGS. 8(*a*) to 8(*e*), the air-direction control vanes 3 extend parallel to the longitudinal axis of the outer frame 1 of the fan guard 19. If the air-direction control vanes 3 extend parallel to the transverse axis of the outer frame 1 of the fan guard 19, then the grid 16 may comprise a plurality of members interconnecting the upper and lower longitudinal members of the outer frame 1 to provide the same advantages as described above.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

Embodiment 9:

FIGS. 9(*a*) to 9(*e*) schematically show an outlet structure for an air-conditioner according to still another embodiment of the present invention. FIG. 9(*a*) is a front view of the outlet structure of an air-conditioner. FIG. 9(*b*) is an enlarged fragmentary front view of the outlet structure shown in FIG. 9(*a*). FIG. 9(*c*) is a side view of the outlet structure of the air-conditioner shown in FIG. 9(*a*), in which air-direction control vanes are disposed downstream of a fan guard. FIG. 9(*d*) is a side view of the outlet structure of the air-conditioner shown in FIG. 9(*a*), in which air-direction control vanes are disposed upstream of a fan guard. Further, FIG. 9(*e*) is a side view of the outlet structure of the air-conditioner shown in FIG. 9(*a*), in which air-direction control vanes are disposed upstream and downstream of a fan guard. Structural details of the air-conditioner which are not shown are identical to those of conventional air-conditioners.

As shown in FIGS. 9(*a*) to 9(*e*), a fan guard 19 has an outer frame 1 fitted in an air passage extending from an air blower to an outlet of an interior unit of an air-conditioner. The outer frame 1 is of a structure which is the same as the conventional outer frame. The fan guard 19 has a grid 2 disposed in the outer frame 1. The grid 2 comprises a plurality of vertical transverse members interconnecting upper and lower longitudinal members of the outer frame 1 and a plurality of horizontal longitudinal members interconnecting lateral transverse members of the outer frame 1. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIGS. 9(*a*) and 9(*b*), the tortuous grid 15 of the fan guard 19, which is disposed in the outer frame 1, comprises a member having a cross-sectional shape that is the same as the circular cross-sectional shape of the members of the grid 2, and extends along a tortuous line having upward and downward curves.

As shown in FIG. 9(*b*), airflows produced downstream of the fan guard 19 by a tortuous grid 15 (described later on) interfere at points 4 with the air-direction control vanes 3 that are positioned downstream of the fan guard 19.

As shown in FIG. 9(*c*), airflows produced by the tortuous grid 15 of the fan guard 19 interfere with the air-direction control vanes 3 that are positioned downstream of the fan guard 19 in a range 18. Therefore, the tortuous grid 15, rather than the grid 2, is disposed in a region where the airflows produced downstream of the fan guard 19 interfere with the air direction control vanes 3.

As shown in FIG. 9(*d*), the fan guard 19 comprises the outer frame 1, the grid 2, and the tortuous grid 15. In FIG. 9(*d*), the air-direction control vanes 3 that are positioned upstream of the fan guard 19 have rear edges movable along a path 20. In FIG. 9(*d*), airflows produced downstream of the rear edges of the air-direction control vanes 3 interfere with the fan guard 19 in a range 17.

In FIG. 9(*e*), since the upstream and downstream air-direction control vanes 3 are arranged to align the range affected by the airflows produced downstream of the fan guard 19 and the range 17 with each other, the range in which the grid 15 is formed is held to a minimum.

Operation of the outlet structure will be described below. In FIGS. 9(*a*) to 9(*c*), the tortuous grid 15 of the fan guard 19 and the air-direction control vanes 3 are disposed not in parallel to each other. Therefore, the air-direction control vanes 3 and the tortuous grid 15 cross each other at points, reducing regions where the airflows interfere with the fan guard 19 and hence air-turbulence noise. If the fan guard 19 is manufactured by welding, it can easily be manufactured because the grid members of the same diameter are assembled by welding.

In FIG. 9(*d*), similarly, the tortuous grid 15 of the fan guard 19 and the air-direction control vanes 3 are not in parallel to each other. Therefore, the air-direction control vanes 3 and the tortuous grid 15 cross each other at points, reducing regions where the airflows interfere with the air-direction control vanes 3 and hence air-turbulence noise.

In FIG. 9(*e*), the tortuous grid 15 of the fan guard 19 and the air-direction control vanes 3 which are positioned upstream and downstream of the fan guard 19 are not in parallel to each other. As is the case with the arrangement shown in FIGS. 9(*a*) to 9(*d*), the tortuous grid 15 and the air-direction control vanes 3 cross each other at points, reducing regions where the airflows interfere with the fan guard 19 and the air-direction control vanes 3 and hence air-turbulence noise.

In FIGS. 9(*a*) to 9(*e*), the air-direction control vanes 3 extend parallel to the longitudinal axis of the outer frame 11 of the fan guard 19. If the air-direction control vanes 3 extend parallel to the transverse axis of the outer frame 1 of the fan guard 19, then the tortuous grid 15 may comprise a plurality of members interconnecting the upper and lower longitudinal members of the outer frame 1 to provide the same advantages as described above.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

Figures 10A, 10B, 10C, 10D, 10E:
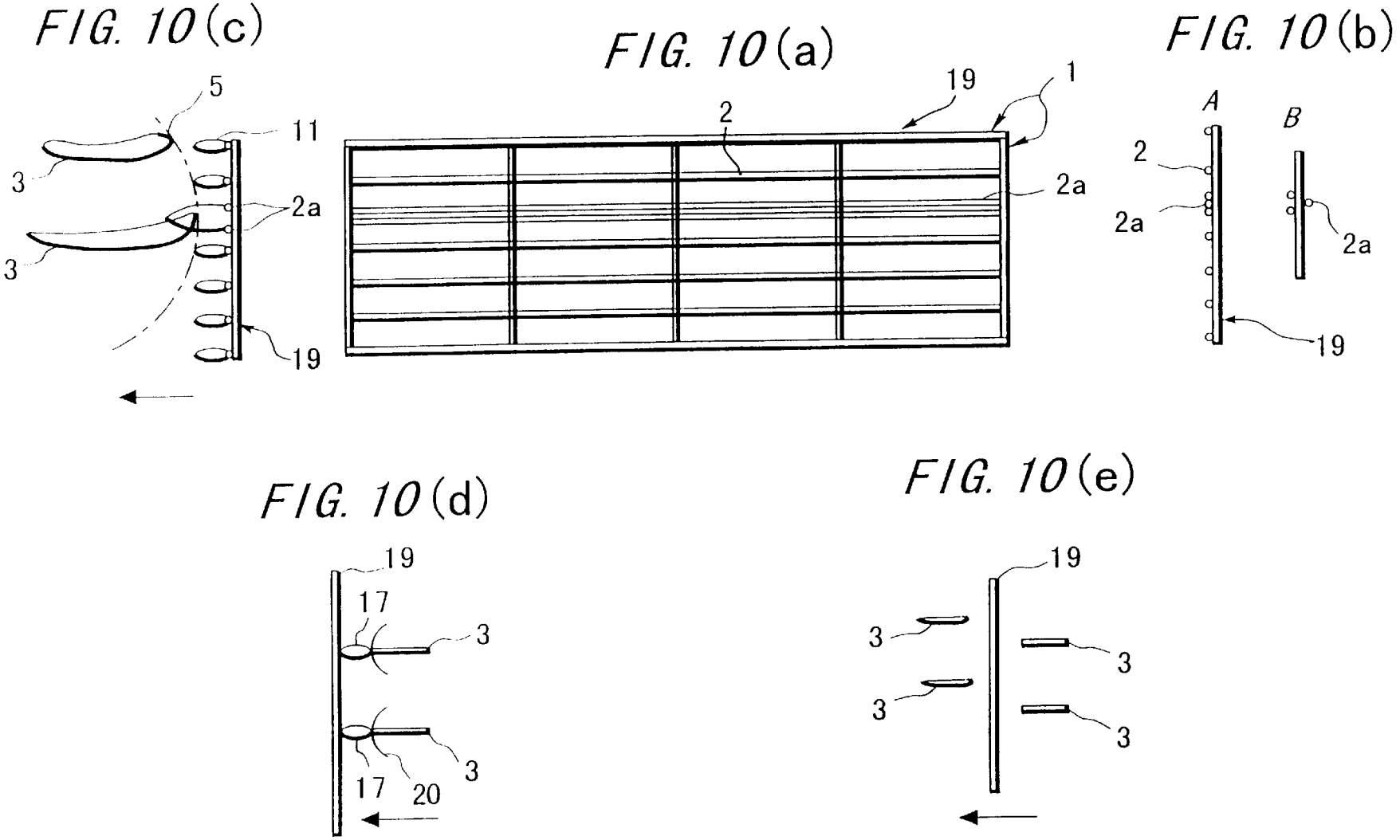
FIGS. 10(*a*) to 10(*e*) are schematic views showing an outlet structure for an air-conditioner according to a tenth embodiment of the present invention.
Figure 11:
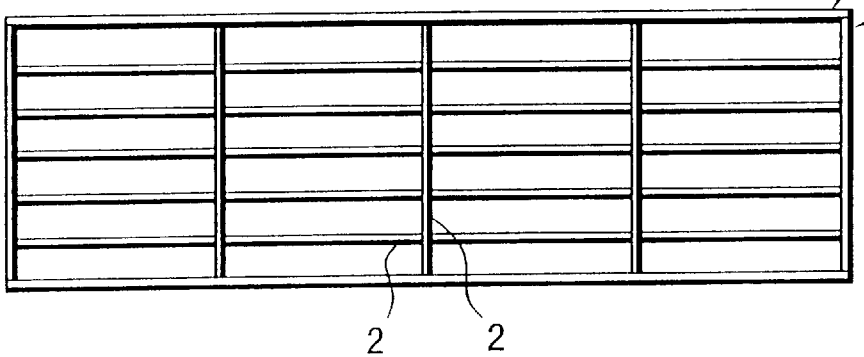
RELATED ART FIG. 11 (a)
FIGS. 11(*a*) to 11(*e*) are schematic views showing a conventional outlet structure for an air-conditioner.
Figure 11:
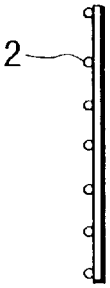
Figure 11:
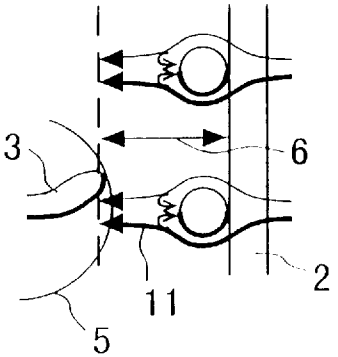
Figure 11:
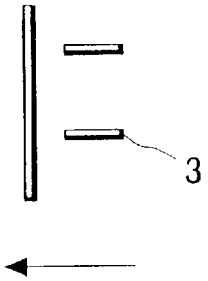
Figure 11:
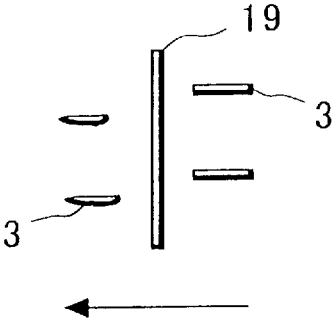

Embodiment 10:

FIGS. 10(*a*) to 10(*e*) schematically show an outlet structure for an air-conditioner according to yet still another embodiment of the present invention. FIG. 10(*a*) is a front view of the outlet structure of an air-conditioner. FIG. 10(*b*) is a side view, showing two embodiments A and B, of the outlet structure of the air-conditioner shown in FIG. 10(*a*). FIG. 10(*c*) is a side view of the outlet structure of the air-conditioner shown in FIG. 10(*a*), in which air-direction control vanes are disposed downstream of a fan guard. FIG. 10(*d*) is a side view of the outlet structure of the air-conditioner shown in FIG. 10(*a*), in which air-direction control vanes are disposed upstream of a fan guard. Further, FIG. 10(*e*) is a side view of the outlet structure of the air-conditioner shown in FIG. 10(*a*), in which air-direction control vanes are disposed upstream and downstream of a fan guard. Structural details of the air-conditioner which are not shown are identical to those of conventional air-conditioners.

As shown in FIGS. 10(*a*) to 10(*e*), a fan guard 19 has an outer frame 1 fitted in an air passage extending from an air blower to an outlet of an interior unit air-conditioner. The outer frame 1 is of a structure which is the same as the conventional outer frame. The fan guard 19 has a grid 2 disposed in the outer frame 1. The grid 2 comprises a plurality of horizontal longitudinal members interconnecting lateral transverse members of the outer frame 1 parallel to longitudinal members of the outer frame 1. Air-direction control vanes 3 are disposed upstream or downstream of the fan guard 19. Each of the air-direction control vanes 3 has a longitudinal axis parallel to the longitudinal axis of the outer frame 1, and rotates about a pivot shaft (not shown) extending longitudinally through the air-direction control vane 3.

As shown in FIG. 10(*c*), the air-direction control vanes 3 that are positioned downstream of the fan guard 19 have front edges movable along a path 5. The fan guard 19 has a grid 2*a* of a different pitch in a range which affects airflows produced downstream of the fan guard 19. The grid 2*a* comprises members of a different pitch than the members of the grid 2 which are positioned outside of the range which affects airflows produced downstream of the fan guard 19. The material and shape of the members of the grid 2*a* are the same as those of the members of the grid 2.

As shown in FIG. 10(*b*), embodiment A, the grid 2*a* is positioned downstream of the fan guard 19. As shown in FIG. 10(*b*), embodiment B, the members of grid 2*a* are positioned both upstream and downstream of the fan guard 19.

As shown in FIG. 10(*d*), the fan guard 19 comprises the outer frame 1 and the grid 2. In FIG. 10(*d*), the air-direction control vanes 3 that are positioned upstream of the fan guard have rear edges movable along a path 20. In FIG. 10(*d*), airflows produced downstream of the rear edges of the air-direction control vanes 3 interfere with the fan guard in a range 17.

In FIG. 10(*e*), since the upstream and downstream air-direction control vanes 3 are arranged to substantially align the range affected by the airflows produced downstream of the fan guard 19 and the range 17 with each other, the range in which the grid 2*a* is formed is held to a minimum.

Operation of the outlet structure will be described below. In FIGS. 10(*a*) to 10(*c*), the grid 2*a* of the different pitch, which is disposed in the range to affect airflows produced downstream of the fan guard 19, is capable of changing the position of strong vortices generated downstream of the fan guard 19 for thereby changing the frequency or intensity of air-turbulence noise into a frequency or intensity which is too low to be audibly perceptible. Alternatively, the grid 2*a* is capable of changing the position of strong vortices into a forward position out of interference with the air-direction control vanes 3. Therefore, the grid 2*a* is effective to reduce air-turbulence noise.

If the fan guard is manufactured by welding, since the grid members of the same diameter are assembled by welding, the fan guard can be manufactured inexpensively and easily without the need for grid members of special dimensions.

In FIG. 10(*d*), similarly, the grid 2*a* of the different pitch, which is disposed in the range 17 where the airflows produced downstream of the air-direction control vanes interfere with the fan guard 19, changes the position of vortices produced downstream of the grid, reducing interference and hence air-turbulence noise.

In FIG. 10(*e*), the grid 2*a* of the different pitch also changes the position of vortices produced downstream of the grid, reducing interference and hence air-turbulence noise, as is the case with the arrangement shown in FIGS. 10(*a*) to 10(*d*). In this embodiment, furthermore, the grid 2*a* for reducing interference with the air-direction control vanes 3 is formed only in the range affected by the airflows downstream of the fan guard 19 and the range 17. Therefore, the grid members in other regions of the fan guard 19 may be of any arbitrary shape most suitable to perform the function of the fan guard 19 or meet other requirements. The outlet structure according to this embodiment is therefore capable of both performing desired functions and reducing air-turbulence noise.

The members of the grids 2 and 2*a* are of the same material and the same shape. Consequently, the fan guard 19 can be mass-produced inexpensively. The position of vortices produced downstream of the fan guard can easily be adjusted by adjusting the pitch of the grid members.

In FIGS. 10(*a*) to 10(*e*), the air-direction control vanes 3 extend parallel to the longitudinal axis of the outer frame 1 of the fan guard 19. If the air-direction control vanes 3 extend parallel to the transverse axis of the outer frame 1 of the fan guard 19, then the pitch of the grid members may be varied in a direction across the upper and lower longitudinal members of the outer frame 1 to provide the same advantages as described above.

Depending on the size of the outlet and the performance of the air-conditioner, the outlet structure may employ a single air-direction control vane 3 or a plurality of air-direction control vanes 3. In either case, the outlet structure will operate in the same manner and offer the same advantages as the above embodiment.

According to the present invention, as described above, an outlet structure for an air-conditioner comprises at least one air-direction control vane disposed on an outlet side of an air blower, and a fan guard disposed upstream of the air-direction control vane for preventing foreign matter from entering the air blower. The fan guard has elements, except an outer frame, disposed not in parallel to a front edge of the air-direction control vane. Therefore, airflows produced downstream of the fan guard interfere with the air-direction control vane at reduced points, thereby reducing air-turbulence noise.

Further, an outlet structure for an air-conditioner comprises at least one air-direction control vane disposed on an outlet side of an air blower, and a fan guard disposed downstream of the air-direction control vane for preventing foreign matter from entering the air blower. The fan guard has elements, except an outer frame, disposed not in parallel to a rear edge of the air-direction control vane. Therefore, airflows produced downstream of the air-direction control vane interfere with the fan guard at reduced points, thereby reducing air-turbulence noise.

Further, an outlet structure for an air-conditioner comprises a fan guard disposed on an outlet side of an air blower for preventing foreign matter from entering the air blower, and at least one air-direction control vane disposed upstream or downstream of the fan guard. The fan guard has elements, except an outer frame, disposed not in parallel to a rear edge of the upstream air-direction control vane or a front edge of the downstream air-direction control vane. Therefore, airflows produced downstream of the fan guard interfere with the air-direction control vane at reduced points, or airflows produced downstream of the air-direction control vane interfere with the fan guard at reduced points, thereby reducing air-turbulence noise.

In another aspect, since the fan guard is disposed not in parallel to the rear edge of the upstream air-direction control vane or the front edge of the downstream air-direction control vane in at least a range in which the rear edge of the upstream air-direction control vane or the front edge of the downstream air-direction control vane interferes with an airflow, a grid of the fan guard which is positioned outside of the range in which the rear edge of the upstream air-direction control vane or the front edge of the downstream air-direction control vane interferes with the airflow is not subject to interference with the airflow, and therefore an arbitrary shape and material which are functionally suitable can be selected for such a grid.

In another aspect, since the fan guard has a grid in a direction oblique to the front edge or rear edge of the air-direction control vane, the airflow interferes with the fan guard and the air-direction control vane only at points of intersection. As the total number of points of interference is reduced, air-turbulence noise is also reduced. Even if the air-direction control vane is arranged to have a plurality of angles (directions) for two-dimensional air-direction control, the fan guard is easily prevented from having a longitudinal grid.

In another aspect, since the fan guard has a grid in a direction oblique to the front edge or rear edge of the air-direction control vane at a plurality of angles, the airflow interferes with the fan guard and the air-direction control vane only at points of intersection. As the total number of points of interference is reduced, air-turbulence noise is also reduced. Even if the air-direction control vane is arranged to have a plurality of angles (directions) for two-dimensional air-direction control, the fan guard is easily prevented from having a longitudinal grid. Because the grid of the fan guard has smaller openings due to the grid in the oblique direction at plural angles, it can prevent smaller foreign matter from entering through the fan guard. The fan guard is thus made highly resistant to entering of a test finger.

In another aspect, the fan guard is disposed not in parallel to the air-direction control vane having the rear edge or the front edge in a most longitudinal direction in at least the range in which the rear edge of the upstream air-direction control vane or the front edge of the downstream air-direction control vane interferes with the airflow. Consequently, points of interference with those air-direction control vanes which have a longest interfering portion and are influential for the generation of noise are reduced, with the result that even if the fan guard is of an arbitrary arrangement in a less influential interference portion, it highly contributes to the reduction of noise, resulting in reduced air-turbulence noise.

In another aspect, the fan guard has a grid having a cross-sectional shape other than a circular shape in the range in which the rear edge of the upstream air-direction control vane or the front edge of the downstream air-direction control vane interferes with the airflow. The grid can change the position of strong vortices produced downstream of the fan guard, for thereby changing the frequency or intensity of air-turbulence noise into a frequency or intensity which is too low to be audibly perceptible. Alternatively, the grid can change the position of strong vortices into a position out of interference with the air-direction control vanes. Therefore, air-turbulence noise can be reduced.

In another aspect, the fan guard has a grid having different thickness in the range in which the rear edge of the upstream air-direction control vane or the front edge of the downstream air-direction control vane interferes with the airflow. The grid can change the position of strong vortices produced downstream of the fan guard, for thereby changing the frequency or intensity of air-turbulence noise into a frequency or intensity which is too low to be audibly perceptible. Alternatively, the grid can change the position of strong vortices into a position out of interference with the air-direction control vanes. Therefore, air-turbulence noise can be reduced. If the fan guard comprises longitudinal and transverse grid members perpendicular to each other and is manufactured using a spot welding process, the grid members can be welded at a reduced number of welding locations, allowing the fan guard to be manufactured inexpensively.

In another aspect, the fan guard has a rectangular grid in the range in which the rear edge of the upstream air-direction control vane or the front edge of the downstream air-direction control vane interferes with the airflow. The grid can change the position of strong vortices produced downstream of the fan guard, for thereby changing the frequency or intensity of air-turbulence noise into a frequency or intensity which is too low to be audibly perceptible. Alternatively, the grid can change the position of strong vortices into a position out of interference with the air-direction control vanes. Therefore, air-turbulence noise can be reduced. If the fan guard comprises longitudinal and transverse grid members perpendicular to each other and is manufactured using a spot welding process, the grid members can be welded at a reduced number of welding locations, allowing the fan guard to be manufactured inexpensively.

In another aspect, the fan guard has a tortuous grid in the range in which the rear edge of the upstream air-direction control vane or the front edge of the downstream air-direction control vane interferes with the airflow. Consequently, points of interference are reduced, thus reducing air-turbulence noise. If the fan guard is manufactured by welding, it can easily be manufactured because grid members of the same diameter are welded together.

In another aspect, the fan guard has a grid having a smaller pitch in the range in which the rear edge of the upstream air-direction control vane or the front edge of the downstream air-direction control vane interferes with the airflow. The grid can change the position of strong vortices produced downstream of the fan guard, for thereby changing the frequency or intensity of air-turbulence noise into a frequency or intensity which is too low to be audibly perceptible. Alternatively, the grid can change the position of strong vortices into a position out of interference with the air-direction control vanes. Therefore, air-turbulence noise can be reduced. If the fan guard is manufactured by welding, it can easily be manufactured because grid members of the same diameter are welded together.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An air-conditioner having an air blow outlet structure which comprises a fan guard disposed on an outlet side of an air blower for preventing foreign matter from entering into said air blower, and at least one air-direction control vane disposed upstream and/or downstream of said fan guard, elements of said fan guard, except an outer frame, being disposed not in parallel to a rear edge of said upstream air-direction control vane or a front edge of said downstream air-direction control vane in at least a range in which the rear edge of said upstream air-direction control vane or the front edge of said downstream air-direction control vane interferes with an airflow.

2. The air-conditioner having an air blow outlet structure according to claim 1, wherein said elements of said fan guard, except an outer frame, are disposed not in parallel to a rear edge of said upstream air-direction control vane or a front edge of said downstream air-direction control vane.

3. An air-conditioner having an air blow outlet structure according to claim 1, wherein said elements of said fan guard, except an outer frame, are disposed in a direction perpendicular to the rear edge of said upstream air-direction control vane or the front edge of said downstream air-direction control vane.

4. An air-conditioner having an air blow outlet structure according to claim 1, wherein said elements of said fan guard, except an outer frame, are disposed in a direction oblique to the rear edge of said upstream air-direction control vane or the front edge of said downstream air-direction control vane.

5. An air-conditioner having an air blow outlet structure according to claim 4, wherein said elements of said fan guard, except an outer frame, are disposed in a direction oblique at an acute angle less than 45 degrees to the rear edge of said upstream air-direction control vane or the front edge of said downstream air-direction control vane.

6. The air-conditioner having an air blow outlet structure according to claim 4, wherein said elements of said fan guard, except an outer frame, are disposed in a plurality directions oblique to the rear edge of said upstream air-direction control vane or the front edge of said downstream air-direction control vane.

7. The air-conditioner having an air blow outlet structure according to claim 4, wherein said elements of said fan guard, except an outer frame, are disposed to cross each other.

8. The air-conditioner having an air blow outlet structure according to claim 1, wherein said elements of said fan guard, except an outer frame, are formed tortuous.

9. An air-conditioner having an air blow outlet structure which comprises a fan guard disposed on an outlet side of an air blower for preventing foreign matter from entering into said air blower, and at least one air-direction control vane disposed upstream and/or downstream of said fan guard, elements of said fan guard, except an outer frame, are formed in a different manner, in a range in which the rear edge of said upstream air-direction control vane or the front edge of said downstream air-direction control vane interferes with an airflow, from the other elements in the other region.

10. The air-conditioner having an air blow outlet structure according to claim 9, wherein said elements of said fan guard, except an outer frame, are formed in a different cross-sectional shape other than a circular shape in the range in which the rear edge of said upstream air-direction control vane or the front edge of said downstream air-direction control vane interferes with the airflow.

11. The air-conditioner having an air blow outlet structure according to claim 9, wherein said elements of said fan guard, except an outer frame, being formed in different thickness in the range in which the rear edge of said upstream air-direction control vane or the front edge of said downstream air-direction control vane interferes with the airflow.

12. The air-conditioner having an air blow outlet structure according to claim 9, wherein said elements of said fan guard, except an outer frame, are formed in rectangular in the range in which the rear edge of said upstream air-direction control vane or the front edge of said downstream air-direction control vane interferes with the airflow.

13. The air-conditioner having an air blow outlet structure according to claim 9, wherein said elements of said fan guard, except an outer frame, are disposed in a smaller pitch in the range in which the rear edge of said upstream air-direction control vane or the front edge of said downstream air-direction control vane interferes with the airflow.

* * * * *

UNITED STATES PATENT AND TRADEMARK OFFICE

CERTIFICATE OF CORRECTION

PATENT NO. : 5,871,334
DATED : February 16, 1999
INVENTOR(S) : Suzuki et al.

It is certified that error appears in the above-identified patent and that said Letters Patent is hereby corrected as shown below:

Drawings,

Sheet 1, Figure 1(b), a down arrow should be applied to the left of and included with the figure as appears in the following:

FIG. 1 (b)

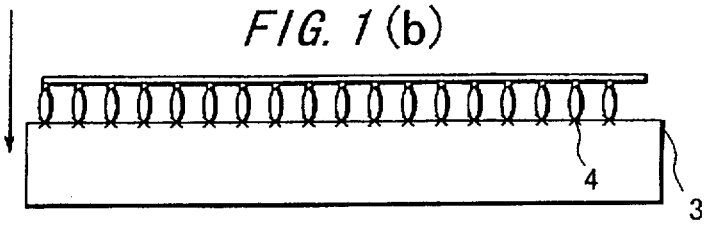

Sheet 1, Figure 1(c), the reference number 19 and its lead line should be deleted as appears in the following:

FIG. 1 (c)

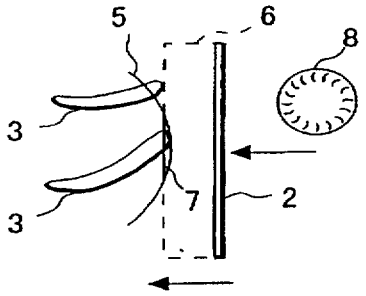

Sheet 1, Figure 1(d), the lead line with no numeral should be deleted as appears in the following:

FIG. 1 (d)

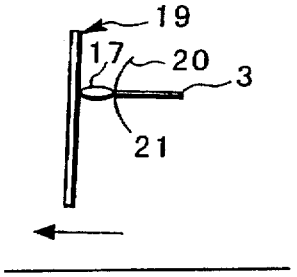

UNITED STATES PATENT AND TRADEMARK OFFICE

CERTIFICATE OF CORRECTION

PATENT NO. : 5,871,334
DATED : February 16, 1999
INVENTOR(S) : Suzuki et al.

Figure 2A:
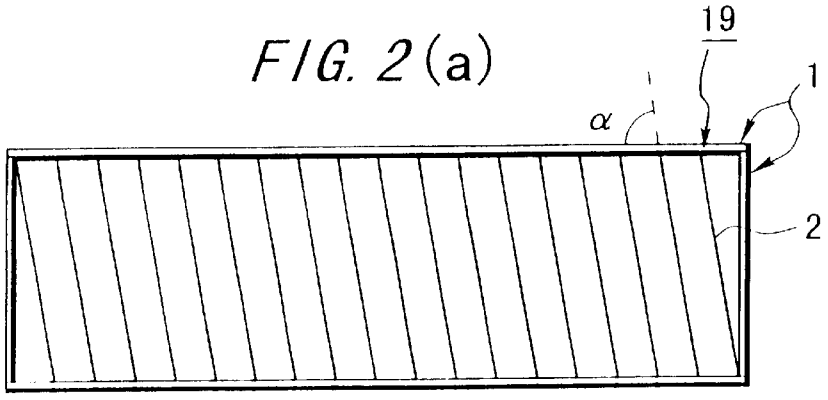

It is certified that error appears in the above-identified patent and that said Letters Patent is hereby corrected as shown below:

Sheet 2, Figure 2(a), the reference number 19 and its lead line should be deleted as appears in the following:

FIG. 2(a)

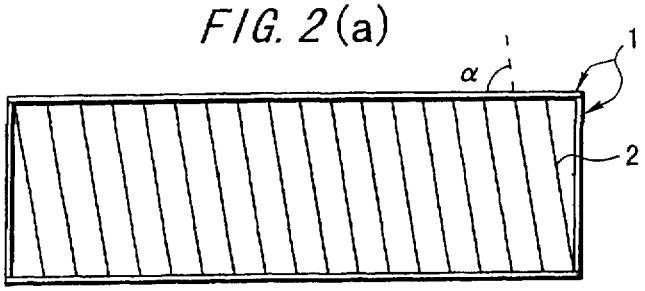

Figure 2B:
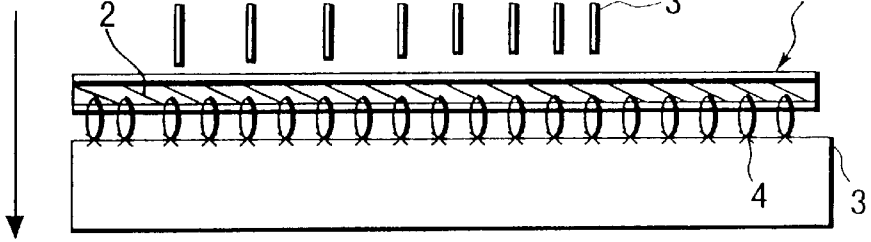

Sheet 2, Figure 2(b), the reference numbers 2 and 19 and their lead lines should be deleted as appears in the following:

FIG. 2(b)

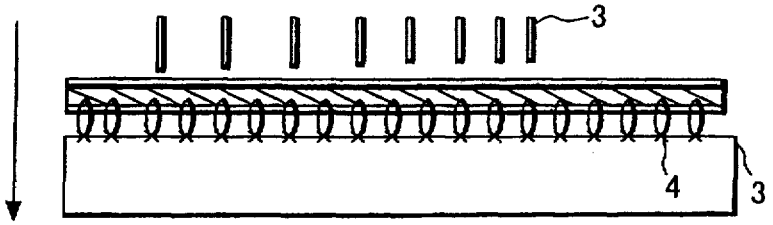

Figure 2C:
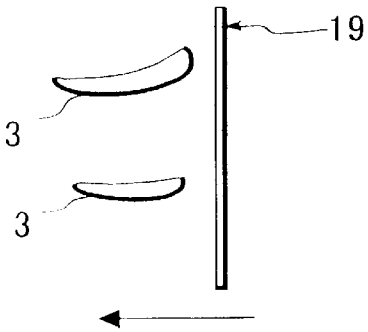
Figure 2D:
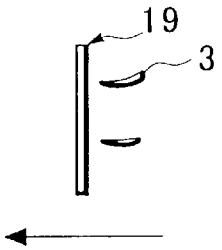

Sheet 2, Figure 2(c), the reference number 19 and its lead line should be deleted as appears in the following:

FIG. 2(c)

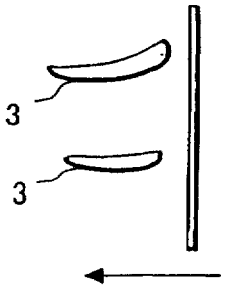

UNITED STATES PATENT AND TRADEMARK OFFICE

CERTIFICATE OF CORRECTION

PATENT NO. : 5,871,334
DATED : February 16, 1999
INVENTOR(S) : Suzuki et al.

Figures 3A, 3B, 3C, 3D, 3E:
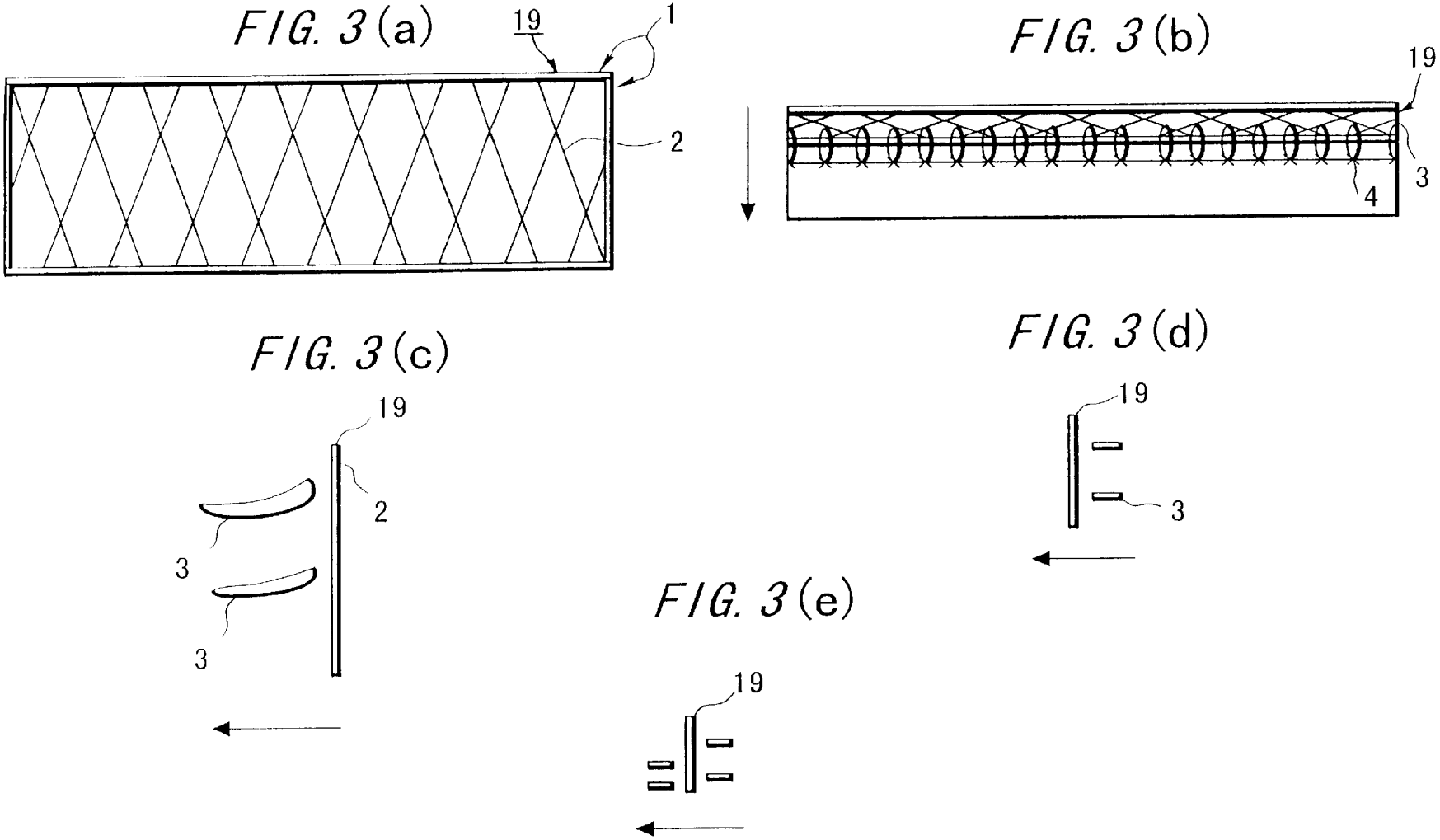
FIGS. 3(*a*) to 3(*e*) are schematic views showing an outlet structure for an air-conditioner according to a third embodiment of the present invention.

It is certified that error appears in the above-identified patent and that said Letters Patent is hereby corrected as shown below:

Sheet 3, Figure 3(a), the reference number 19 and its leading line should be deleted as appears in the following:

FIG. 3 (a)

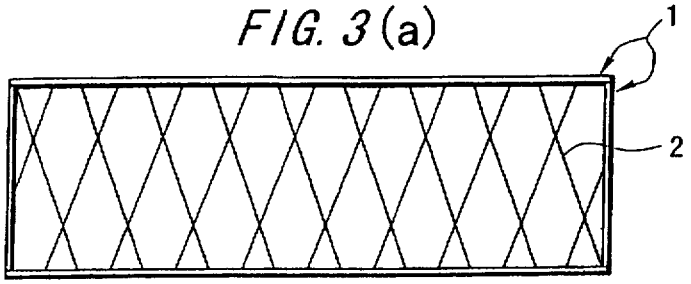

Sheet 3, Figure 3(b), the reference number 19 and its leading line should be deleted as appears in the following:

FIG. 3 (b)

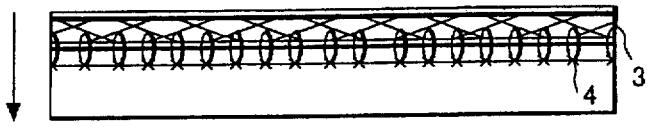

Figures 4A, 4B, 4C, 4D, 4E:
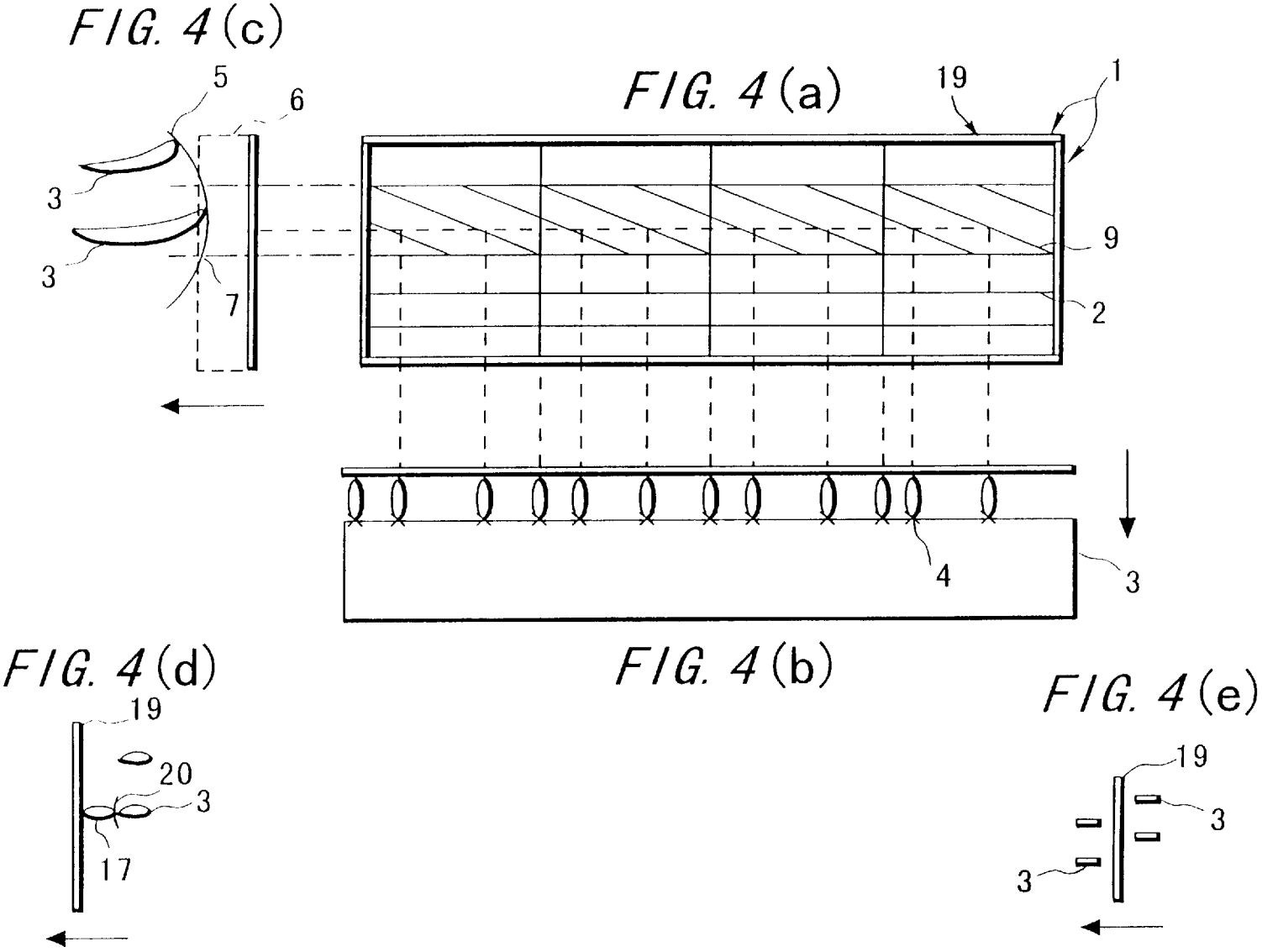
FIGS. 4(*a*) to 4(*e*) are schematic views showing an outlet structure for an air-conditioner according to a fourth embodiment of the present invention.

Sheet 4, Figure 4(a), the reference number 19 and its leading line should be deleted as appears in the following:

FIG. 4 (a)

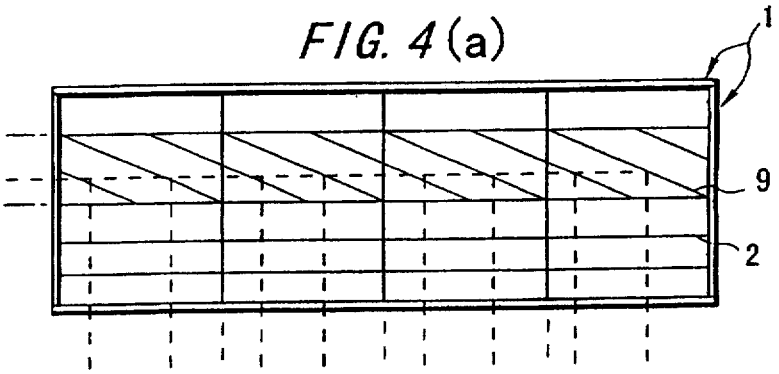

UNITED STATES PATENT AND TRADEMARK OFFICE

CERTIFICATE OF CORRECTION

PATENT NO. : 5,871,334
DATED : February 16, 1999
INVENTOR(S) : Suzuki et al.

Figures 5A, 5B, 5C, 5D, 5E:
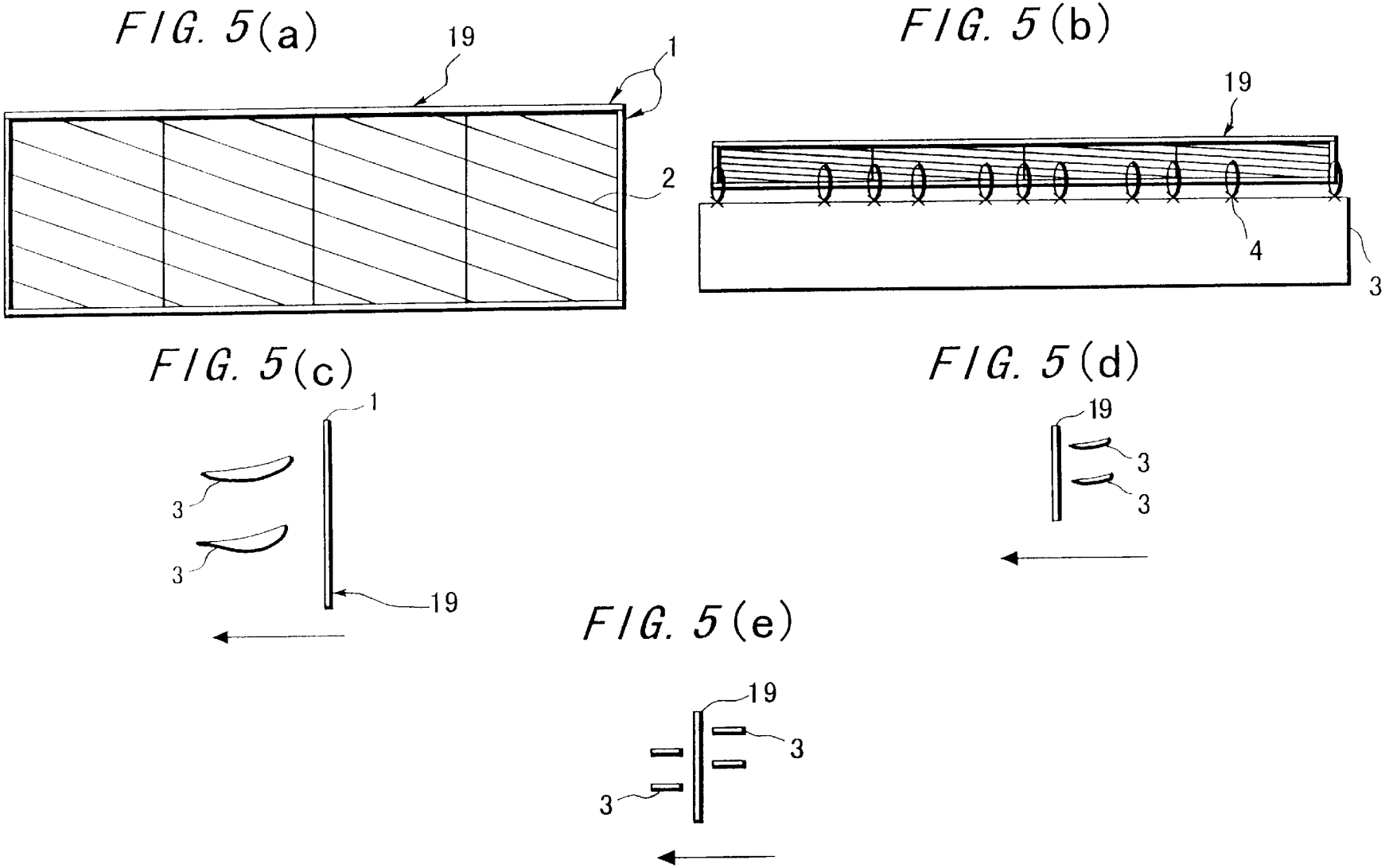
FIGS. 5(*a*) to 5(*e*) are schematic views showing an outlet structure for an air-conditioner according to a fifth embodiment of the present invention.

It is certified that error appears in the above-identified patent and that said Letters Patent is hereby corrected as shown below:

Sheet 5, Figure 5(a), the reference number 19 and its leading line should be deleted as appears in the following:

FIG. 5(a)

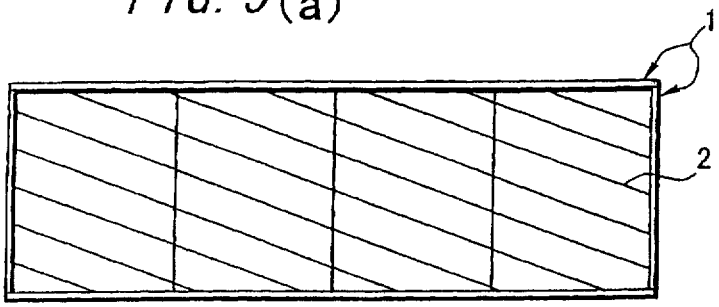

Sheet 5, Figure 5(b), the reference number 19 and its leading line should be deleted as appears in the following:

FIG. 5(b)

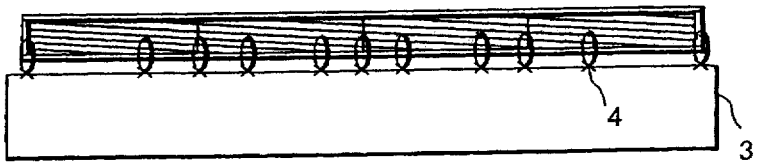

UNITED STATES PATENT AND TRADEMARK OFFICE

CERTIFICATE OF CORRECTION

PATENT NO. : 5,871,334
DATED : February 16, 1999
INVENTOR(S) : Suzuki et al.

It is certified that error appears in the above-identified patent and that said Letters Patent is hereby corrected as shown below:

Sheet 5, Figure 5(c), the reference number 19 and its leading line should be deleted as appears in the following:

FIG. 5(c)

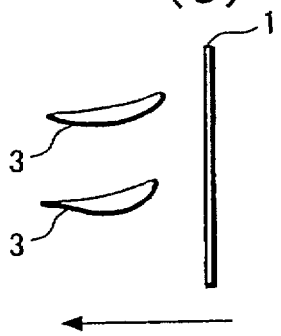

Signed and Sealed this

Fourteenth Day of May, 2002

*Attest:*

*Attesting Officer*

JAMES E. ROGAN
*Director of the United States Patent and Trademark Office*